US012741834B2

(12) United States Patent
Lohner et al.

(10) Patent No.: US 12,741,834 B2
(45) **Date of Patent: *Sep. 22, 2026**

(54) MODULAR FEEDER

(71) Applicant: Zehnder & Sommer AG, Burgdorf (CH)

(72) Inventors: Erich Lohner, Burgdorf (CH); Urs Fankhauser, Burgdorf (CH)

(73) Assignee: Zehnder & Sommer AG, Burgdorf (CH)

( * ) Notice: Subject to any disclaimer, the term of this patent is extended or adjusted under 35 U.S.C. 154(b) by 230 days.

This patent is subject to a terminal disclaimer.

(21) Appl. No.: 18/491,277

(22) Filed: Oct. 20, 2023

(65) Prior Publication Data

US 2024/0132310 A1 Apr. 25, 2024
US 2024/0228204 A9 Jul. 11, 2024

(30) Foreign Application Priority Data

Oct. 21, 2022 (EP) ..... 22203035

(51) Int. Cl.
*B65H 1/26* (2006.01)

(52) U.S. Cl.
CPC .... *B65H 1/266* (2013.01); *B65H 2301/31124* (2013.01); *B65H 2405/5521* (2013.01)

(58) Field of Classification Search
CPC ..... B21D 43/11; B21D 43/09; B21D 43/13
See application file for complete search history.

(56) References Cited

U.S. PATENT DOCUMENTS

| | | | | |
|---|---|---|---|---|
| 4,694,982 A | | 9/1987 | Plumb | |
| 4,925,081 A | * | 5/1990 | Vecchi | B65H 23/28 242/615.3 |
| 5,505,360 A | | 4/1996 | Giusto | |
| 2022/0128089 A1 | | 4/2022 | Nara et al. | |

FOREIGN PATENT DOCUMENTS

| | | | |
|---|---|---|---|
| CN | 108817248 | A | 11/2018 |
| DE | 2534914 | A1 | 2/1977 |
| DE | 3629368 | A1 | 3/1988 |
| GB | 703762 | A | 2/1954 |
| JP | H02186107 | A | 7/1990 |
| JP | 2002301530 | | 10/2002 |

OTHER PUBLICATIONS

European Search Report for EP 22203035.5, issued Apr. 13, 2023 (9 pages).
Extended European Search Report for EP 25211894.8, mailed Jan. 19, 2026, with English translation (18 pages).

* cited by examiner

*Primary Examiner* — Howard J Sanders
(74) *Attorney, Agent, or Firm* — Devlin Law Firm LLC

(57) ABSTRACT

A feeder for conveying a workpiece, in particular strip material, in a conveying direction, comprises at least one first pair of side support modules; a base support module arranged between the side support modules; and at least one conveying module; wherein the side support modules are detachably connected to the base support module transversely to the conveying direction to form a U-shaped support structure of the feeder along the conveying direction; wherein the conveying module is arranged on the support structure movably in the conveying direction.

4 Claims, 15 Drawing Sheets

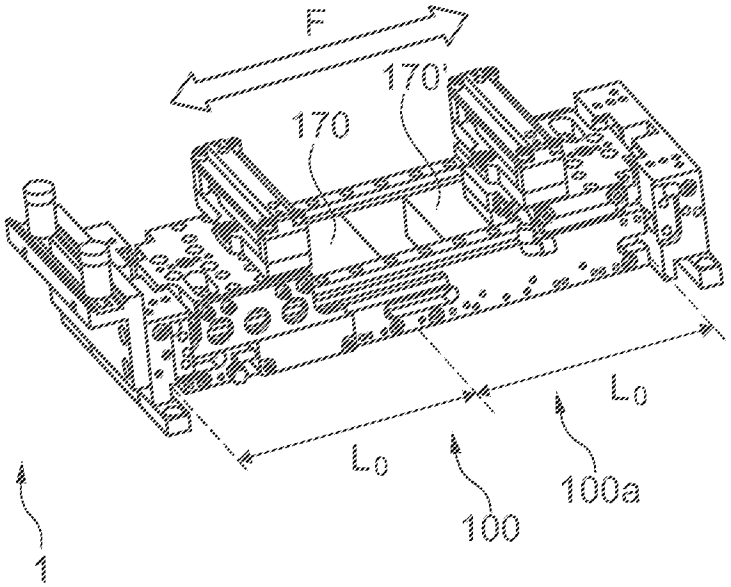
Fig. 10
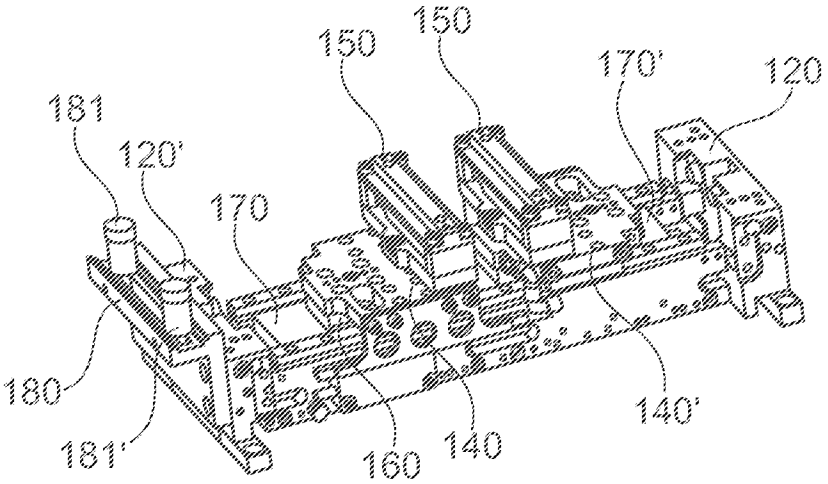

MODULAR FEEDER

CROSS-REFERENCE TO RELATED APPLICATIONS

This application claims priority to European patent application no. 22203035.5, filed on Oct. 21, 2022, the disclosure of which is incorporated by reference herein in its entirety.

TECHNICAL FIELD

The present invention relates to a feeder, in particular a modular feeder, for conveying a workpiece such as strip material. The feeder comprises side support modules and a base support module, which are configured such that feeders can be formed for different feeder applications.

STATE OF THE ART

Material conveying devices, in particular feeders such as pincer feeders or roller feeders, are used for conveying and feeding, in particular for the clocked feeding of workpieces, such as strip material or sheet material. For example, gripper feeders or roller feeders are used in sequential cutting tools, such as punching applications. The workpiece is fed in a clocked manner, wherein the clocking of the feeder is synchronized with a punching tool.

The principle of the feeder is to be illustrated by way of example on a strip material in the gripper feeder: the gripper feeder can comprise a fixed gripper and a movable gripper. The stationary strip material is held or clamped by the fixed gripper. The movable gripper is in a starting position. By means of a control signal, usually initiated by a sequential cutting tool, the movable gripper now clamps the strip material and at the same time the fixed gripper releases the clamping ("releasing"). Subsequently, the movable gripper carries out a linear feeder movement up to an end position. The feeder movement can be predefined by a controller. When the end position is reached, the fixed gripper again clamps the strip material, and the movable gripper releases the clamping. Subsequently, the movable gripper carries out a linear movement back into the starting position. The above-described sequence can also be referred to as a cycle or feeder cycle. The feeder cycle is repeated as often as a controller receives a starting signal.

A gripper feeder also comprises a main body (or also referred to as support structure), which imparts stability to the feeder and can receive movable components and/or drive units. Usually, the movable gripper moves along a longitudinal direction of the main body.

Some requirements are imposed on a feeder, for example a gripper feeder. The production and procurement of the feeder should be simplified and cost-effective. In particular, the production of the components of the feeder should be cost-effective. In addition, feeders should be able to be flexibly converted and/or adapted in order to cover different areas of use. For example, different areas of use/requirements such as feeder lengths, feeder widths, pressing forces (for holding the strip material), feeder cycles per unit of time (cycle rate, thus accelerations of the movable components) should be facilitated. Component dimensions of the feeders should also be reduced due to space restrictions in factory premises.

Conventional feeders do not meet this requirement profile. Conventional feeders have, for example, integral and bulky components, wherein the components are designed only for one purpose, one assembly orientation and one assembly position. Consequently, conventional feeders are limited to a specific area of use. For a different area of use, a completely different and new feeder has to be procured. These feeders are consequently very inefficient when considered as a whole. In the event of damage to a component, the procurement of a replacement component is usually cost- and time-intensive.

It is therefore an object of the present invention to overcome the disadvantages of the state of the art. In particular, the present invention is directed to the object of providing a feeder for conveying a workpiece which is modular and can be flexibly modified to different areas of use. The modification should be cost-efficient. It is furthermore an object of the invention to provide modules/components for a feeder, so that simple modification is efficiently made possible. In addition, a structurally compact feeder should be provided. In particular, the conveying of strip material should be safe, less susceptible to failure and fast.

SUMMARY OF THE INVENTION

The above objects as well as further objects which result from the following description are solved by the subject matter of the independent claims. Preferred embodiments are the subject matter of the dependent claims, and the person skilled in the art finds indications of other suitable embodiments of the present invention in the disclosure of the present application.

A 1. embodiment of the invention relates to a feeder for conveying a workpiece, in particular strip material, in a conveying direction, comprising: at least one first pair of side support modules; a base support module arranged between the side support modules; and at least one conveying module; wherein the side support modules are detachably connected to the base support module transversely to the conveying direction to form a U-shaped support structure of the feeder along the conveying direction; wherein the conveying module is arranged on the support structure movably in the conveying direction.

The feeder according to the invention (also referred to without limitation and merely for illustration as a "modular" feeder) comprises components which make it possible to flexibly provide feeders for different requirements. The feeder can be easily upgraded, rebuilt and/or changed in construction.

The components used are of modular design and can comprise mounting means/end faces which are universal, standardized and/or congruent to one another. Consequently, a flexible assembly of the components to form a feeder is made possible. This saves costs and contributes to a favorable assembly of a feeder.

The requirements of the feeders can comprise a maximum installation space. For this requirement, the feeder according to the invention makes possible a flexible rebuilding of an existing feeder using similar components. A feeder can then be formed which takes up a different installation space (for example a changed/smaller geometric dimension such as width/height/length).

The components of the feeder can be produced in a multiplicity and in particular in a larger number of pieces. The production of these components can be optimized with respect to the increased number of pieces, as a result of which the production can be made more efficient.

The "components" of the feeder can be understood to mean the modules described herein. A side support module and a base support module are, however, to be understood herein as a respective (single) integral component. The side support modules described herein can in particular be similar for example uniform. A "pair of side support modules" can be understood such that the two side support modules do not touch one another in conjunction with the base support module as a support structure.

A conveying module can comprise a plurality of components, as described herein.

The strip material conveyed with the feeder could be used, for example, for producing elements or precision parts of numerous industrial sectors, including the sectors automobile, electrical and electronics, household goods, cosmetics, spray cans, medical technology or electrical sheets.

The feeder can be configured to convey strip material in two different directions, preferably in two opposite directions. Thus, for example, a simple change of the arrangement of components can be carried out in order to change one direction. For example, a support plate of the feeder (as a result of which strip material can be introduced) can be mounted on one side and on the other side along the conveying direction. In a further example, an end plate of the feeder can be mounted at any end of the support structure of the feeder.

It is also possible to provide a multiplicity of holding devices (for example on the movable conveying module). The holding devices can come into engagement with strip material. Consequently, if necessary, the pressing force on a strip material can be increased. In this way, it is possible to accelerate the strip material to an increased extent. This contributes to an increase in the throughput of strip material and makes the application of the feeder efficient. The number of holding devices can be flexibly adjusted, for example on the basis of different thicknesses of the strip material, in order to ensure a desired cycle rate. This ensures overall more efficient processing of strip material in the feeder, in particular in feeders with sequential cutting tools.

The conventional feeders lack such advantages since conventional feeders are limited to one application and are designed only for this purpose. Conventional components of conventional feeders are not of modular design and have no standardized mounting means and/or no symmetries which make possible a flexible assembly and rebuilding.

The support structure of the feeder according to the invention can be composed of three modules. This can be understood such that the support structure is of divided design (divided into components). The support structure of the feeder is to be understood such that it provides sufficient stability to be able to operate the feeder. For example, movements and loads can thus be absorbed by the conveying module. Furthermore, the support structure can receive further components of the feeder (e.g., a drive unit, magnetic rails, a carriage plate, movable holding devices) and provide stability to these further components. Without such a support structure, this would not be possible.

Conventional support structures are of integral, consequently one-piece, design. For reasons of stability, a division into individual components of the support structures in conventional feeders has not previously been provided. In addition, a sequence of conventional support structures is not possible.

Advantageously, the support structure according to the invention (of divided design but detachably connectable) can be used in any way for feeders of different applications and/or requirements. For example, the same first pair of side support modules can be used in feeders of a different width, for example for the application of a different strip material width.

The U-shaped support structure can be understood such that a profile in the cross section of the support structure at right angles to the conveying direction (longitudinal direction of the support structure) substantially reproduces a U. In this case, the "U" can be angular and smaller deviations from a conventional "U" can be comprised.

A 2. embodiment relates to the preceding embodiment, wherein the side support modules can be detachably connected to the base support module in a mutually exchangeable manner.

With this embodiment, the modularity can be increased, and a flexible applicability of the components can be made possible. For example, individual components can be exchanged as desired if they are damaged (for example during operation of the feeder). This does not require a far-reaching change of other components. Consequently, the undamaged part of the feeder remains unchanged, as a result of which the costs can be reduced.

In one example, the side support modules can also be procured/produced in stock, by which and due to the increased number of pieces, a cost saving is associated. Compared to an exchange of an entire support structure, it is thus possible to be able to carry out an exchange in a targeted and efficient manner.

It is advantageous that one component of a feeder can be replaced by another component of the same feeder. This could be expedient, for example, if the feeder is exposed to a greater load on one side. Consequently, a rebuilding/exchange of the components with one another can be carried out so that overall, a more uniform material loading can be ensured. This increases the service life of the feeder compared to conventional feeders.

A 3. embodiment relates to one of the preceding embodiments, wherein the feeder is configured such that the conveying module can still be movably arranged on the support structure in the conveying direction when the side support modules are mutually exchanged.

This offers the advantage that the exchange of the side support modules does not impede an operation of the feeder. Consequently, the same feeder can still be operated.

A 4. embodiment relates to one of the preceding embodiments, wherein the side support modules have first mounting means for detachable connection to the base support module.

The detachable connection offers the advantage of simplified dismantling/rebuilding and/or simplified expansion of the feeder. Consequently, a flexible assembly of the components to form a feeder is made possible.

A 5. embodiment relates to one of the preceding embodiments, wherein the side support modules have end faces which are configured such that a further pair of similar side support modules can be arranged on the first pair of side support modules in the conveying direction such that the length of the support structure is extended by the length of a side support module when the base support module is replaced by an extended base support module, the length of which is greater than the length of the base support module by the length of a side support module.

It is advantageous that the further pair is likewise similar. This contributes to the efficient use of a plurality of equal components. In one example, the pairs of side support modules can be arranged such that substantially two rows are formed, wherein the base support module is arranged between the rows. The base support module merely needs to be of longer design; consequently, in one example, a support structure twice as long can be achieved (in the case of three pairs, for example, a support structure three times as long as in the case of one pair).

In one example, it is likewise possible for the base support module to be of wider design. In this case, equal side support modules can still be used.

A 6. embodiment relates to one of the preceding embodiments, wherein the feeder is configured such that, when a further pair of similar side support modules is arranged in the conveying direction, the conveying module can still be movably arranged on the support structure in the conveying direction.

At least the statements and advantages relating to the 3. embodiment are prevailing.

A 7. embodiment relates to one of the preceding embodiments, wherein the side support modules and the base support module are configured such that, when a further pair of similar side support modules is arranged in the conveying direction, the further similar side support modules can be detachably connected to the extended base support module transversely to the conveying direction to be able to form the support structure of the feeder along the conveying direction.

The detachable connection increases the operability of the components used. The connection transversely to the conveying direction provides sufficient stability so that the support structure formed can withstand the loads of the feeder during operation. Consequently, the feeder can be operated substantially securely.

An 8. embodiment relates to one of the preceding embodiments, wherein the end faces of the side support modules are congruent to one another so that, when a further pair of similar side support modules is arranged, the end faces abut one another at least partially flush.

Congruent to one another can mean that the faces are quite similar to one another and have a matching shape to one another. Thus, in one example, a continuous transition from one side support module to a further side support module along a row of side support modules can be made possible.

A 9. embodiment relates to one of the preceding embodiments, wherein the end faces of the side support modules have recesses, preferably U-shaped recesses, wherein, when a further pair of similar side support modules is arranged, the recesses form a common opening with a substantially continuous circumferential surface.

This offers the advantage that the accessibility during assembly of the feeder is improved. In particular, the inner region of the support structure is thus accessible via the outer sides for cables and/or hoses (e.g. pneumatic hoses), or the like. Consequently, the cables and/or hoses can already be connected at both ends, and subsequently inserted laterally through the recess. The cables and/or hoses can thus already be prefabricated.

In one example, the "recesses" mean that one end face has a recess, and the other end face correspondingly likewise has a recess.

The end faces can be understood to mean the two surfaces of a side support module arranged at opposite ends in the longitudinal direction of a side support module. Consequently, the end faces are oriented normally to the conveying direction and parallel to one another.

In one example, the recess at one end face can be longer in the longitudinal direction than the recess at the other end face in the longitudinal direction. This can be advantageous since more threaded bores for receiving a sensor can thus be provided on an outer side of the side support module toward the side with the shorter recess in the longitudinal direction. Furthermore, sufficient access for cables and/or hoses is flexibly provided.

In one example, the limbs of the U-shaped recesses are arranged parallel to the conveying direction.

A substantially continuous circumferential surface can mean, for example, that there are no strong and/or noticeable edges. Nevertheless, manufacturing tolerances are included and should be taken into account so that edges can occur in some cases.

A 10. embodiment relates to the preceding embodiment, wherein the end faces of the side support modules have second mounting means configured such that the side support modules can be detachably connected to an end plate of the feeder.

The first and second mounting means described herein can comprise fastening holes. Advantageously, it is then possible to line the end faces of the side support modules longitudinally to one another, wherein a fastening of the side support modules to the end plate is also possible. The end faces thus perform two functions, as a result of which the flexibility is increased. Conventional end faces are designed only for one function.

In one example, in the feeder according to the invention, at least the end faces on one side of the first pair of side support modules are detachably connected to the end plate. These end faces are to be understood as the two end faces of the two side support modules of the first pair of side support modules. These two end faces can lie on a common plane. An end plate (a second, similar) can also be fastened to the other side of the first pair of side support modules. However, a second pair of side support modules can also be arranged on the other side of the first pair of side support modules.

An 11. embodiment relates to one of the preceding embodiments, wherein the base support module has first mounting means on both sides arranged transversely to the conveying direction, which, optionally, are configured for force-fitting connection to the first mounting means of the side support modules.

Advantageously, the first mounting means of the base support module are arranged such that an exchange of the side support modules with one another still enables a detachable connection. Consequently, any desired side support module can be used, for example during assembly, and no separate side has to be selected.

In addition, material loadings can be reduced sensibly, as described herein. In addition, the first mounting means of the base support module enable the further pairs of side support modules to be detachably connected to the base support module even in the case of a sequence of further pairs of side support modules.

The stability of the support structure is consequently ensured, wherein at the same time a division of the support structure into a plurality of components is enabled. It is not necessary to detachably connect the sequence of pairs of side support modules with one another since the base support module provides an (indirect) connection. This connection takes place, in one example, over the entire length of the sequence of pairs of side support modules.

The first mounting means can comprise fastening holes, for example. For example, screws can be guided through the first mounting means of the side support modules, which screws engage in the first mounting means of the base support module.

Force-Fitting

A 12. embodiment relates to one of the preceding embodiments, wherein the side support modules are elongated and substantially define a U-shaped profile with legs of different lengths, wherein the smaller leg of each side support module is substantially flush with the base support module.

This offers the advantage that cables, hoses or the like can be collected in the region of the web of the U-shaped profile and is protected from impairments. Nevertheless, a detachable connection to the base support module can be made possible with the smaller leg. The flush termination offers the advantage that, for example, a component arranged in the support structure can protrude in a planar manner beyond the base support module and the flush termination. A wider component (width here to be understood as transverse to the longitudinal direction) can thus be arranged in the support structure without cables, hoses or the like being damaged.

The U-shaped profile can be understood such that a profile in the cross section of the side support module at right angles to the conveying direction (longitudinal direction of the side support module) substantially reproduces a U. In this case, the "U" can be angular and smaller deviations from a conventional "U" can be comprised.

A 13. embodiment relates to one of the preceding embodiments, wherein the feeder comprises a guide rail arranged on the support structure, and wherein the side support modules have third mounting means for detachably connecting the guide rail to a side support module, wherein, optionally, the guide rail and the third mounting means of the side support modules are configured such that the guide rail can be connected to a plurality of side support modules arranged in the conveying direction at the same time.

The guide rail can be configured such that it receives movable components of the feeder, for example the conveying module. Furthermore, the guide rail can guide the conveying module in both directions for example along the conveying direction (e.g., the conveying module can be moved in both directions, wherein one of the directions corresponds to the conveying direction). Consequently, the conveying module can carry out a translational movement. Two guide rails can also be comprised by the feeder, which are then respectively arranged on both side support modules of the first pair of side support modules.

The embodiment additionally offers the advantage that a plurality of side support modules can be connected to a guide rail in the longitudinal direction. Consequently, the guide rails can perform two functions, namely the guiding of the conveying module and an increase in the stability of the feeder.

A 14. embodiment relates to one of the preceding embodiments, wherein the base support module has second mounting means arranged, optionally, in pairs along the conveying direction, wherein the feeder comprises at least one drive unit, preferably an electric drive unit, most preferably a linear motor; wherein the drive unit is received in the support structure and configured to move the conveying module, wherein the second mounting means of the base support module are arranged such that the drive unit can be detachably connected to the base support module at variable positions along the conveying direction.

This offers the advantage that the drive unit can be positioned arbitrarily and flexibly in the longitudinal direction (parallel/along the conveying direction). Consequently, a desired overlap between the drive unit and the magnetic plate of the conveying module can be achieved. The position of the drive unit can be subsequently changed, in particular in the case of an already existing feeder, to another desired feeder application case. The drive unit can be positioned, for example, at a first end of the support structure if it is desired that a large acceleration is present at the beginning of a travel path of the conveying module.

The base support module can consequently have a plurality of spaced-apart fastening holes in order to allow an adjustment of the drive unit in a longitudinal direction. The second mounting means can be arranged, for example, at equidistant intervals or at equidistant intervals in sections in the longitudinal direction of the base support module (conveying direction). The second mounting means of the base support module are oriented, for example, at right angles to the first mounting means of the base support module.

The drive unit can be bounded by the support structure transversely to the conveying direction. For example, the legs of the U-shaped support structure can bound the drive unit transversely to the conveying direction.

A 15. embodiment relates to one of the preceding embodiments, further comprising two end plates detachably connected to the support structure, preferably not to the base support module, at opposite sides of the support structure.

The opposite sides of the support structure can be considered to be opposite along the conveying direction. The end plates then substantially define the ends of the support structure in the longitudinal direction (conveying direction).

Preferably, the end plates are detachably connected to the end faces of the side support modules (via the second mounting means of the side support modules). A fastening to the base support module is thus advantageously not necessary.

It is possible that the end plates in combination with the support structure protrude beyond the end faces of a pair of side support modules. This provides more space for mounting and can contribute to stability.

A 16. embodiment relates to one of the preceding embodiments, wherein the end plates are configured such that the end plates can be detachably connected to the support structure in a mutually exchangeable manner, wherein, optionally, the feeder is configured such that the conveying module can still be movably arranged on the support structure in the conveying direction when the end plates are mutually exchanged.

The end plates can have fastening holes which are preferably arranged symmetrically on the end plates. Consequently, an exchange of the end plates with one another is made possible. This increases the flexibility and contributes to the modularity.

Furthermore, at least the statements and advantages relating to the 3. and 6. embodiment are prevailing.

A 17. embodiment relates to one of the preceding embodiments, wherein the end plates have a recess in the conveying direction, which is configured to at least partially receive the conveying module during operation of the feeder.

The recess offers the advantage that the conveying module can cover a longer travel path with a constant total length of the feeder (measured on the basis of the spacing of the outer sides of the end plates in the longitudinal direction). Consequently, a relatively enlarged travel path of the carriage plate/holding device(s) arranged on the conveying module can be made possible and thus the strip material can be reliably guided over a relatively enlarged path.

An 18. embodiment relates to one of the preceding embodiments, wherein the length of the base support module in the conveying direction corresponds to the length of the first pair or pairs of side support modules.

The base support modules described herein are usually elongate, wherein the longitudinal direction can run along the conveying direction, in particular parallel to the conveying direction. The base support module can be of integral and one-piece design.

A pair of side support modules is usually arranged such that the side support modules are arranged opposite, consequently transversely to the conveying direction. Thus, the length of a pair of side support modules corresponds to the length of a side support module. If a plurality of pairs of side support modules are arranged in a sequence, the base support module has the length of the sum of the length of all pairs of side support modules. This increases the stability and robustness of the U-shaped support structure formed.

Accordingly, the support structure can be understood such that the rows of side support modules are detachably connected on both sides to the individual intermediate base support module.

A 19. embodiment relates to one of the preceding embodiments, wherein the feeder comprises at least one guide rail, wherein the length of the guide rail in the conveying direction corresponds to the length of the first pair or pairs of side support modules.

This offers the advantage that the stability of the feeder can be further increased. In particular, the guide rail can extend over the entire length of the sequence of side support modules and thus form a detachable connection therewith. This embodiment combines the advantages of the guide rail already described above.

A 20. embodiment relates to one of the preceding embodiments, wherein the side support modules each have a length of at most 250 mm, preferably at most 210 mm, further preferably at most 180 mm, further preferably at most 150 mm, further preferably at most 140 mm, further preferably at most 135 mm, most preferably at most 131 mm or 130 mm; and/or a length of at least 50 mm, preferably at least 70 mm, further preferably at least 90 mm, further preferably at least no mm, further preferably at least 120 mm, further preferably at least 125 mm, most preferably at least 129 mm.

According to the invention, a good compromise is created with this length of the side support module in terms of sufficient stability on the one hand (greater length desirable) and in terms of increased modularity of the feeder on the other hand (smaller length desirable). The side support modules can thus be produced in a higher number of pieces and can be used in a plurality in one feeder. Feeders of different feeder applications can thus also be formed from equal components.

In one example, the feeder can comprise exactly one pair of side support modules so that the feeder has a feeder length in the range of 120-140 mm, preferably 125-135 mm.

In a further example, the feeder can comprise exactly two pairs of side support modules so that the feeder has a feeder length in the range of 250-270 mm, preferably 255-265 mm.

In a further example, the feeder can comprise exactly three pairs of side support modules so that the feeder has a feeder length in the range of 380-400 mm, preferably 385-395 mm.

In a further example, the spacing of two end plates can be at most 500 mm, preferably at most 450 mm, further preferably at most 420 mm, further preferably at most 400 mm, most preferably at most 391 mm; and/or at least 70 mm, preferably at least 90 mm, further preferably at least no mm, most preferably at least 129 mm.

A 21. embodiment relates to one of the preceding embodiments, wherein the first and optionally second and optionally third mounting means of the side support modules and optionally the first and optionally the second mounting means of the base support module are each arranged symmetrically on the respective modules.

This offers the advantage that a simple exchange and/or rebuilding of the components of a feeder is made possible. This increases the flexibility and reduces the costs.

The symmetrical arrangement could be understood such that, for example, the mounting means have an equal spacing from a main axis of the respective module. Furthermore, the mounting means can be formed substantially similarly.

A 22. embodiment relates to one of the preceding embodiments, further comprising one or more further pairs of similar side support modules, wherein the pairs of side support modules are arranged adjacent to each other in the conveying direction, wherein the side support modules are detachably connected to the base support module transversely to the conveying direction to form the support structure of the feeder along the conveying direction.

A feeder of modular components is thus advantageously provided. This feeder can be produced in a cost-effective manner.

A 23. embodiment of the invention relates to a feeder for conveying a workpiece, in particular strip material, in a conveying direction, comprising: a support structure formed along the conveying direction; and at least one conveying module arranged on the support structure movably in the conveying direction and comprising a carriage plate and at least one elongate holding device, which are preferably detachably connected to each other; wherein the longitudinal axis of the holding device extends substantially parallel to the normal of the carriage plate.

The "elongate" holding device is to be understood such that there is at least one dimension of the holding device which is longer than two dimensions oriented substantially at right angles thereto (the dimensions can be understood as corresponding to the three spatial directions of a three-dimensional coordinate system). For example, a narrow plate can also be understood as elongate if one side is longer than the two remaining sides (in each case at right angles to the long side).

The carriage plate can have a plate-like shape which can also be planar. Consequently, a normal on this plate/surface can be identified. It can be the case, for example, that the carriage plate has a surface which is larger than the other surfaces. The normal of the carriage plate is then usually understood as the normal of this larger surface.

This embodiment of the invention offers the advantage that, for example, an existing feeder can be rotated and can still be used as feeder. For example, the feeder can be rotated about the conveying direction, preferably by 85° to 95°, most preferably by 89° to 91°. The rotation described herein can also take place in the opposite direction. The rotation can also comprise a rotation about the angles described herein plus one or more of 360°.

This embodiment is advantageous for requirements which are imposed by narrow strip materials and/or wires or the like. Wide holding devices are not necessary for these requirements. Consequently, the space required for the feeder can be saved. In addition, if the given space ratio (for example in a factory premise) does not support a horizontal/lying (non-rotated) feeder, a feeder can be rotated and, with assembly of the same components, the rotated feeder can be formed which has a smaller width.

The structural design of the components can support a rotation of the feeder about the longitudinal axis of the feeder. In some cases, structural adaptations can be made to the rotated feeder in order to be able to operate it for a new (in contrast to the non-rotated state) requirement.

It is advantageous that the components of the feeder can be equal components of the embodiments described herein due to their modular/similar/universal nature.

A 24. embodiment relates to the preceding embodiment, further comprising at least one end plate preferably detachably connected to the support structure at a side of the support structure lying along the conveying direction, wherein the end plate has a first dimension along the normal of the carriage plate which is smaller than a second dimension extending substantially at right angles to the normal of the carriage plate and to the conveying direction.

The first dimension described herein can also be understood to mean a width of the end plate for this embodiment. The feeder is thus advantageously of narrow design and nevertheless operable.

The second dimension is thus substantially at right angles to the normal of the carriage plate and at right angles to the conveying direction. In one example, this dimension can also be understood to mean a height for this embodiment.

A 25. embodiment relates to the preceding embodiment, wherein the ratio of second and first dimension is at least 1.2, preferably at least 1.4, more preferably at least 1.6, more preferably at least 1.8, more preferably at least 2.0, more preferably at least 2.2, more preferably at least 2.4, more preferably at least 2.6, more preferably at least 2.8, more preferably at least 3.0, most preferably at least 3.2.

This further contributes to an optimized use of space and increases the flexibility and applicability of the feeder.

A 26. embodiment relates to one of the embodiments 24 or 25, comprising a further similar end plate, wherein the end plates are preferably detachably connected to the support structure at opposite sides of the support structure in the conveying direction.

An advantage of this embodiment is that the feeder can be fastened to a wall with a surface of the support structure and/or of the end plates and can still be operable. In this case, the surface of the support structure and/or of the end plates is to be understood as one which would usually run substantially parallel to a base if the feeder were to be operated in a lying condition.

A 27. embodiment relates to one of the embodiments 23 to 26, wherein the conveying module comprises a planar magnetic rail which is connected to the carriage plate such that its normals run substantially parallel.

The magnetic rail usually comprises a magnet. The magnetic rail usually has a surface which is larger than the other surfaces. The normal of the magnetic rail is then usually understood as the normal of this larger surface.

This embodiment has the advantage that the drive (via the magnetic rail which is driven by the drive unit) runs substantially transversely to the holding devices. Thus, overall, a large overlap of a drive unit and the magnetic rail can be achieved (thus an advantageous acceleration and cycle rates of the feeder), wherein at the same time the space requirement is adapted and optimized to the requirements.

A 28. embodiment relates to one of embodiments 23 to 27, wherein the support structure has a U-shaped profile along the conveying direction, wherein the carriage plate of the conveying module is arranged substantially on the legs of the U-shaped profile, and wherein the normal of the carriage plate is directed substantially from the web of the U-shaped profile to the opening of the U-shaped profile.

The advantages mentioned above also apply to this embodiment. The U-shaped profile can serve to accommodate the drive unit. Consequently, the orientation of the U-shaped profile makes possible an optimized drive and space requirement.

A 29. embodiment relates to one of embodiments 24 to 28, wherein the end plates have at least two outer faces oriented substantially at right angles to one another.

This offers the advantage that the feeder can be accommodated substantially on the outer faces before and after a rotation, such that a fixed stand can be ensured.

A 30. embodiment relates to one of embodiments 23 to 29, wherein the carriage plate is configured such that the holding device can also be detachably connected to the carriage plate with its longitudinal axis at right angles to the normal of the carriage plate, and preferably also at right angles to the conveying direction.

The holding devices can consequently be reoriented (for example rotated by 90°) and can still be detachably connected to the carriage plate in the rotated orientation. Holding devices can thus be arranged, for example, on a narrow side of the feeder. The same carriage plate and the same holding device can advantageously be used for this purpose. The components can thus be produced in a cost-effective manner.

In one example, the holding device can be detachably connected in a first orientation to an upper side of the carriage plate and in a second orientation to an outer side of the carriage plate. The upper side of the carriage plate can be, for example, the opposite side from the side which is directed toward the web of the U-shaped profile of the support structure. Consequently, the opposite side from the side which is directed toward a drive motor (which is accommodated within the U-shaped profile). The outer side of the carriage plate can laterally bound the upper side of the carriage plate. The outer side can be directed toward a leg of the U-shaped profile of the support structure.

A 31. embodiment relates to one of the embodiments 23 to 30, if dependent on the embodiment 24, wherein the dimension of the holding device in the longitudinal direction is at most 150%, preferably at most 140%, further preferably at most 130%, further preferably at most 120%, further preferably at most 120%, further preferably at most 110%, further preferably at most 100% of the first dimension of the end plate.

A 32. embodiment relates to one of the embodiments 23 to 31, wherein the feeder is one of the feeders according to one of the embodiments 1 to 22.

The features, properties and advantages mentioned in the present invention also apply to this and the following embodiments, if this is technically meaningful. This and the following embodiments can also be combined with all features of the previous embodiment if this is technically meaningful.

A 33. embodiment of the invention relates to a feeder for conveying a workpiece, in particular strip material, in a conveying direction, comprising: a support structure which is formed along the conveying direction; and a first and a second conveying module which are arranged on the support structure so as to be movable in the conveying direction; wherein the conveying modules are arranged on the support structure so as to be movable independently of one another in the conveying direction.

This embodiment offers the advantage that the conveying modules (and the carriage plates comprised by them) can be controlled individually. They can also be moved over an individual path along the conveying direction of the strip material.

It is advantageous that the components of the feeder can be equal components of the other embodiment described herein due to their modular/similar/universal nature.

The strip material can advantageously be controlled by a movable holding device during operation of the feeder, for example at any time. Thus, no spatially fixed holding device(s) are required.

A 34. embodiment relates to the preceding embodiment, wherein the feeder comprises a first and a second drive unit received in the support structure and preferably detachably connected to the support structure, wherein the drive units are configured to move the first and the second conveying module.

For example, the first drive unit can ensure that a carriage plate moves in one direction and thus guides the strip material in this direction. In addition, the second drive unit could drive the other carriage plate, which moves in the opposite direction, substantially at the same time.

The feeder can consequently be operated with an increased clock rate. This contributes to an efficient and cost-effective feeder.

A 35. embodiment relates to one of embodiments 33 or 34, wherein the support structure has mounting means arranged such that the drive units can be detachably connected to the support structure at variable positions along the conveying direction.

The drive unit can consequently be positioned arbitrarily and flexibly in the longitudinal direction (parallel/along the conveying direction). Consequently, a desired overlap between the drive unit and the conveying module (in particular a magnetic plate which can be comprised by the conveying module) can be achieved.

The position of the drive unit can be subsequently changed, in particular in the case of an already existing feeder, to another desired feeder application case.

The support structure can, in one example, have a plurality of spaced-apart fastening holes in order to allow an adjustment of the drive unit in a longitudinal direction. The mounting means can be arranged, for example, at equidistant intervals or at equidistant intervals in sections in the longitudinal direction of the support structure (conveying direction).

The drive unit can be bounded by the support structure transversely to the conveying direction. For example, the legs of the U-shaped support structure can bound the drive unit transversely to the conveying direction.

A 36. embodiment relates to one of the embodiments 33 to 35, wherein the feeder is one of the feeders according to one of the embodiments 1 to 32.

The features, properties and advantages mentioned in the present invention also apply to this and the following embodiments, if this is technically meaningful. This and the following embodiments can also be combined with all features of the previous embodiments if this is technically meaningful.

A 37. embodiment of the invention relates to a feeder for conveying a workpiece, in particular strip material, in a conveying direction, comprising: a support structure which is formed along the conveying direction; and a first and a second conveying module which are arranged on the support structure so as to be movable in the conveying direction; wherein the conveying modules are configured such that they can at least partially overlap in the conveying direction.

This embodiment offers the advantage that the feeder can be of compact design in terms of length (along the conveying direction) and can nevertheless perform a long path length (stroke). The overlap does not disturb the normal operation and travel path of the two conveying modules. The installation space required can thus be reduced. This can save space in factory premises, for example, and contributes to cost reduction. In one example, the conveying modules can also be operated independently of one another.

In one example, the part of the conveying module which overlaps can also be only a part of magnetic rails. In a further example, the part can also comprise a carriage plate and/or a gripper plate.

The overlap can be understood such that, for example, in a cross section through the feeder perpendicular to the conveying direction (for example a cross section in the center of the support structure), a part of the first and a part of the second conveying module would each be visible.

In this way, the feeder makes possible a travel path of a carriage plate (comprised by the conveying module) over a length of at least 30%, preferably at least 40%, further preferably at least 45%, most preferably at least 50% of the entire length of the support structure.

The feeder can, in one example, also be formed by the assembly of two feeders. This is an advantage with regard to the procurement of the components (for example by a series effect).

The strip material can advantageously be controlled by a movable holding device during operation of the feeder at any time. Thus, no spatially fixed holding device(s) are required. The material guidance can be improved by this control.

A 38. embodiment relates to the preceding embodiment, wherein the conveying modules are configured such that they cannot overlap in the conveying direction.

A 39. embodiment relates to one of embodiments 37 or 38, wherein the conveying modules are configured such that they at least partially overlap in the conveying direction during operation of the feeder at any time.

A 40. embodiment relates to one of embodiments 37 to 39, wherein the support structure is formed from a first and a second similar support structure element, which are preferably detachably connected to each other at the rear side.

The similar support structure elements consequently enable a simplified preferably detachable connection to a support structure. Consequently, equal components can be used. The rear side can be understood herein as the side of a support structure element which is usually directed toward the base of feeders in lying condition.

A 41. embodiment relates to the preceding embodiment, wherein the support structure elements have a substantially flat rear side, preferably without projections, in order to abut one another substantially flush.

This offers the advantage that the support structure elements can be detachably connected to each other in a simplified manner. For example, there are substantially only slight or no unevennesses which can adversely affect the connection.

A 42. embodiment relates to one of embodiments 40 or 41, wherein the support structure elements contact each other over an area of at least 10%, preferably at least 20%, more preferably at least 30%, more preferably at least 40%, more preferably at least 50%, more preferably at least 50%, more preferably at least 60%, more preferably at least 70%, most preferably at least 80% of the rear side.

This offers the advantage that an increased contact area can be provided. Consequently, less dirt or other foreign substances can accumulate between the support structure elements.

The support structure elements can have at the rear side, in one example, a groove along the conveying direction, which can serve to fasten the feeder to angle brackets, so that, for example, the orientation of the feeder can be optimized. If a base support module is comprised, the groove can be provided on the rear side of the base support module.

A 43. embodiment relates to one of the embodiments 40 to 42, further comprising two first end plates which are preferably detachably connected to the first support structure element at opposite sides of the first support structure element, wherein the end plates each have a substantially flat rear side, preferably without projections, in order to terminate substantially flush with the first support structure element.

This promotes the provision of a simplified and preferably detachable connection. The area of the components touching one another can thus be increased in the case of the rear-side connection. This promotes assembly possibilities.

A 44. embodiment relates to the preceding embodiment, further comprising two second similar end plates which are detachably connected to the second support structure element at opposite sides of the second support structure element; wherein at least one of the two second end plates is detachably connected at the rear side to at least one of the two first end plates.

A 45. embodiment relates to one of the embodiments 37 to 44, wherein the feeder is one of the feeders according to one of the embodiments 1 to 36.

The features, properties and advantages mentioned in the present invention also apply to this and the following embodiments, if this is technically meaningful. This and the following embodiments can also be combined with all features of the previous embodiments if this is technically meaningful.

A 46. embodiment relates to one of the preceding embodiments, wherein the conveying module comprises a carriage plate and a magnetic rail, which are configured such that they can be detachably connected to each other at a variable distance, optionally at a variable distance, along the conveying direction, wherein, optionally, the conveying module comprises a plurality of preferably similar carriage plates and/or magnetic rails, which are configured such that they can be detachably connected to each other along the conveying direction, preferably adjacent to each other.

The magnetic rail can, for example, be driven by the drive unit and then moved. This movement is transmitted to the carriage plate. The variable distance increases the flexibility of the mounting and contributes to the modularity of the feeder. The magnetic rail can, for example, be used in a plurality, which are detachably connected to the carriage plate in a row in the conveying direction.

The magnetic rail can be detachably mounted on an underside of the carriage plate so that the magnetic rail has only a slight spacing from the drive unit arranged there below. This contributes to the efficient movement of the conveying module.

The carriage plate can have a substantially flat/planar shape. This can reduce the height of the feeder and contributes to the compact design of the feeder.

This embodiment has the advantage that the magnetic rails are similar and can be used modularly in a feeder. A sequence of magnetic rails can thus be carried out in order to reproduce any desired length of magnetic rails.

A 47. embodiment relates to one of the preceding embodiments, wherein the conveying module further comprises at least one holding device, which is configured such that it can be detachably connected to the carriage plate at a variable distance to the carriage plate along the conveying direction.

The carriage plate can have a plurality of fastening holes, for example. Consequently, the equal carriage plate (also referred to herein as similar) can be used for different feeder applications. This increases the flexibility.

The holding device can, for example, be detachably connected to the carriage plate close to a first end of the carriage plate (viewed parallel to the conveying direction). This can be expedient if a greater sag of strip material is not critical for conveying. The holding device can also be detachably connected to the carriage plate at the opposite end of the carriage plate. A sag of strip material could thus be reduced.

A 48. embodiment relates to one of the preceding embodiments, wherein the holding devices are configured to come into engagement with the workpiece, wherein, optionally, the holding devices are pneumatically driven, wherein, optionally, the holding devices are grippers.

A plurality of holding devices offers the advantage that an increased clamping force can be generated. Higher cycle rates could thus also be achieved. The pneumatic operation represents a safe technology and promotes a safe operation of the feeder.

A 49. embodiment relates to one of the preceding embodiments, further comprising a support plate configured to be detachably connected at opposite sides of the support structure.

The opposite sides of the support structure can be understood as viewed along the conveying direction. This increases the modularity since the equal support plate can be detachably connected at both sides of the support structure. A further advantage is that the same feeder can be operated in different conveying directions by carrying out a simple change of a component. The support plate can be detachably connected to an end plate of the feeder, wherein the end plate can be detachably connected to the support structure.

A 50. embodiment relates to one of the preceding embodiments, further comprising at least one or more of the following: a guide roller, an infeed guide attachment, a gripper plate, a lateral cover plate, an upper cover plate, an assembly foot.

The components mentioned in this embodiment have similar advantages as already described above. In particular, they can be exchanged as desired, for example if they are arranged in a plurality in the feeder.

The guide rollers are, for example, configured to guide the strip material. In one example, the support plate can comprise two guide rollers which are arranged as a pair and are arranged at the same distance from the longitudinal axis of the feeder.

The lateral cover plate can run substantially parallel to the side of the legs of the U-shaped profile of the support structure.

A 51. embodiment relates to one of the preceding embodiments, wherein the feeder further comprises at least one guide rail, wherein the length of a guide rail in the conveying direction corresponds to the length of the support structure.

The stability of the feeder is thus further increased. In particular, the guide rail can extend over the entire length of the sequence of side support modules and thus form a connection therewith. This embodiment combines the advantages of the guide rail already described above.

A 52. embodiment relates to one of the preceding embodiments, wherein the feeder comprises a guide rail having a length of at most 250 mm, preferably at most 210 mm, further preferably at most 180 mm, further preferably at most 150 mm, further preferably at most 140 mm, further preferably at most 135 mm, most preferably at most 131 mm or 130 mm; and/or having a length of at least 50 mm, preferably at least 70 mm, further preferably at least 90 mm, further preferably at least 110 mm, further preferably at least 120 mm, further preferably at least 125 mm, most preferably at least 129 mm.

Similar advantages as described above for the side support modules apply to the guide rail.

A 53. embodiment relates to one of the preceding embodiments, wherein the feeder is a gripper feeder or a roller feeder, preferably a gripper feeder.

A 54. embodiment relates to one of the preceding embodiments, wherein the feeder has a width, preferably a width of an end plate, of at most 300 mm, preferably at most 250 mm, more preferably at most 220 mm, further preferably at most 200 mm, most preferably at most 190 mm, and/or has a width of at least 50 mm, preferably at least 70 mm, more preferably at least 90 mm, further preferably at least 100 mm, most preferably at least 112 mm, wherein, optionally, the width of the end plate corresponds to the largest dimension of the end plate.

A good compromise is created with this width in terms of sufficient assembly possibilities on the end plate for increasing the modularity on the one hand (greater width desirable) and in terms of a compact design of the feeder on the other hand (smaller width desirable).

The width of the end plate usually corresponds to the largest dimension which the end plate has in three dimensions oriented at right angles to one another.

A 55. embodiment relates to one of the preceding embodiments, wherein the feeder has a height, preferably a height of an end plate, of at most 300 mm, preferably at most 250 mm, more preferably at most 220 mm, further preferably at most 200 mm, most preferably at most 140 mm; and/or has a height of at least 30 mm, preferably at least 40 mm, more preferably at least 50 mm, further preferably at least 60 mm, most preferably at least 70 mm, wherein, optionally, the height of the end plate does not correspond to the largest dimension of the end plate, and, optionally, the height of the end plate does not correspond to the dimension of the end plate in the conveying direction.

The height of the end plate can be understood, for example, as at right angles to the width.

A 56. embodiment relates to one of the preceding embodiments, wherein the feeder comprises holding devices having a clamping force of at least 100 N, preferably at least 135 N, further preferably at least 150 N, further preferably at least 200 N, further preferably at least 250 N, most preferably at least 280 N, and/or wherein the feeder comprises holding devices having a clamping force of at most 14,000 N, preferably at most 5,000 N, further preferably at most 4,000 N, further preferably at most 3,000 N, most preferably at most 2,000 N; optionally upon a pressurization of the pneumatic holding devices of at least 2 bar, preferably at least 2.5 bar, further preferably at least 3 bar, further preferably at least 3.5 bar, further preferably at least 4 bar, further preferably at least 4.5 bar, further preferably at least 5 bar, further preferably at least 5.5 bar, most preferably at least 6 bar, and/or optionally upon a pressurization of the pneumatic holding devices of at most 10 bar, preferably at most 8 bar, further preferably at most 7 bar, most preferably at most 6 bar.

An optimum contact pressure (pressure application) can be determined depending on the use case. It can be advantageous to set a low contact pressure. A low contact pressure can have a positive effect on the possible cycle rates. The less compressed air has to be pumped into the holding devices, the shorter the time which the holding devices require for clamping the strip material. This can consequently result in a larger number of strokes per minute.

A 57. embodiment relates to one of the preceding embodiments, wherein the feeder is configured to carry out clock rates of at least 200, preferably at least 250, more preferably at least 300, more preferably at least 350, most preferably at least 400, and/or to carry out clock rates of at most 2,500, preferably at most 2,000, more preferably at most 1,500, more preferably at most 1,400, most preferably at most 1,300.

The clock rate can also depend on other parameters of the feeder and can be set/defined in an application-specific manner. For example, the clock rate can depend on the feeder angle (available time window per stroke) and/or length of the conveyance of the strip material per cycle. In the case of a short feeder length, the clock rate can usually be greater. In the case of greater feeder lengths, the clock rate can be smaller.

BRIEF DESCRIPTION OF THE FIGURES

Preferred embodiments are described below only by way of example. Reference is made to the following accompanying figures:

FIG. 10 shows a feeder with two drive units according to an embodiment of the present invention in a first position of the carriage plates (left) and a second position of the carriage plates (right);

DETAILED DESCRIPTION OF THE FIGURES

Definitions

Figure 1:
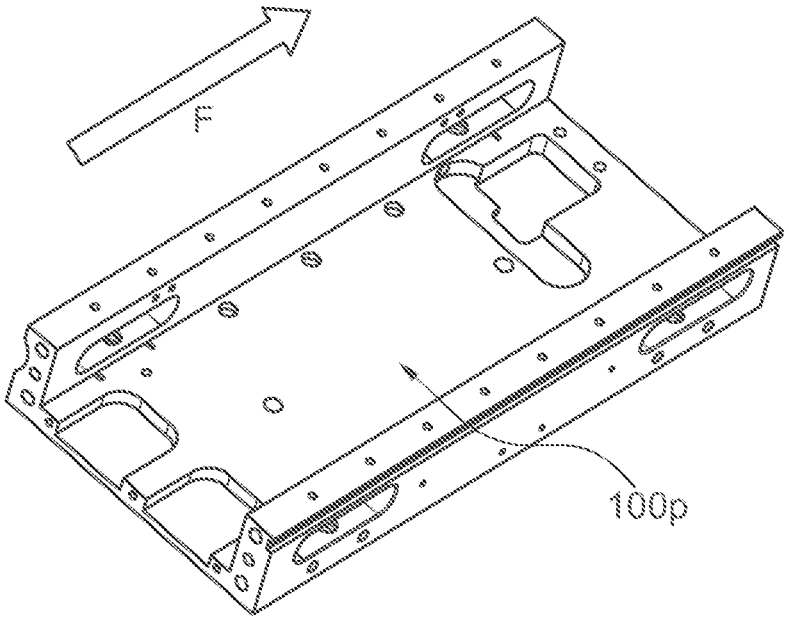
Fig. 1 (prior art)
FIG. 1 shows a conventional main body of a conventional feeder, as is known from the state of the art.

The term "modular", "modularized" and/or "modularization" can mean that a device described by the term and/or a system and/or component described by the term are combined as desired (for example with the same and/or a different modular device/system/component) in order to provide the same or a different/any desired configuration (for example any desired configuration of a feeder). The "modular" components can comprise standardized/uniform/universal interfaces, for example mounting means/mounting surfaces/end faces, in order to be able to be detachably connected to each other and/or to other components. Consequently, the components, elements or modules can interact flexibly with each other.

The term "similar", for example a "similar" side support module or "similar" side support modules, can be understood such that the components are substantially equal, preferably identical. Manufacturing tolerances are included by the term "similar". Consequently, two components which have manufacturing inaccuracies can nevertheless be referred to as similar. The manufacturing inaccuracies are substantially low so that they are scarcely detectable in some cases and two "similar" components can consequently be considered identical by an average person.

The term "mountable", "mounted", "mounting", "mount", "mounted to each other", "mounted thereto", "fastening", "fastened", "connected", "composite" can be understood such that, for example, two components are substantially fixedly connected to each other. Consequently, substantially no movement of the components relative to each other is possible. For example, two components mounted to one other or to each other are rotationally fixed and/or translationally fixed.

The term "detachable", for example "detachably mounted" or "detachably connected", can be understood such that a connection between two components can be detached substantially without destruction. If not designated separately, "detachable" is to be understood as "mechanically detachable". The terms are to be understood such that a physical separation of the components is made possible. This can be done e.g., by force-fitting/friction-fitting (e.g., by screw connections) or in some cases by a form-fitting. Usually, a material connection, for example welding, does not fall under a "detachable" mounting, as used herein.

The term "assembly", "assembling", "assembled" can be understood such that components are preferably detachably mounted to each other or are arranged such that they restrict a specific movement.

The term "feeder cycle" is to be understood as a movement sequence of the holding device movable from a starting to an end and back to a starting position. During a feeder cycle, strip material is conveyed by one feeder length. The number of feeder cycles per unit of time is also to be understood as "cycle rate" and is usually expressed as stroke/min.

A "width of the holding device", for example of a gripper, can be understood such that the width corresponds approximately to the width of the feeder. However, it is also possible to provide wider grippers than the width of the feeder.

A "passage width" of the holding device can be understood such that this corresponds to a maximum possible strip material width that can be conveyed. It goes without saying that the width of the holding device is greater than the passage width.

The distance between two end plates parallel to the conveying direction is referred to herein as "length" of the feeder. A "feeder length" can be understood such that it is the feeder length of a strip material of a feeder per cycle. The feeder length is usually used herein as a synonym for the length of the feeder.

DESCRIPTION OF FIGURES

Only a few possible embodiments of the invention are described in detail below. However, the present invention is not limited thereto, and a multiplicity of other embodiments can be applied without departing from the scope of the invention.

The embodiments presented can be modified and combined with each other in many ways, whenever they are compatible, and specific features can be omitted, insofar as they appear unnecessary. In particular, the disclosed embodiments can be modified by combining specific features of one embodiment with one or more features of another embodiment.

In the entire present Figures and the description, the same reference signs refer to the same elements, in part for reasons of clarity some reference signs have been omitted and/or reference signs for the same components have been provided with a dashed line. The Figures may not be true to scale, and the relative size, proportions and representation of elements in the Figures can be exaggerated for clarity, illustration and expediency.

Figure 2:
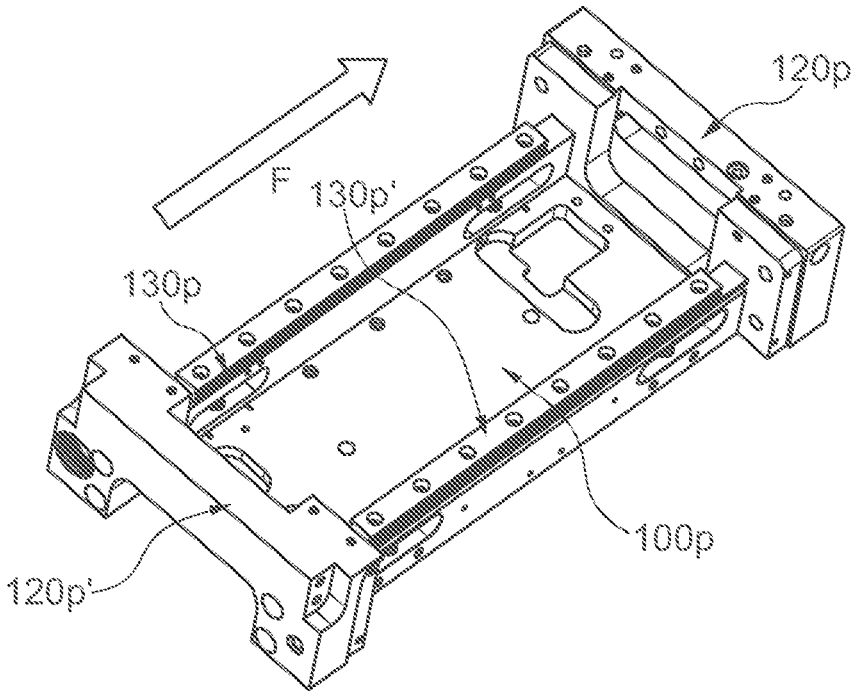
Fig. 2 (prior art)
FIG. 2 shows the conventional base body from FIG. 1 with further components of a conventional feeder, as is known from the state of the art.

FIGS. 1 and 2 show a conventional main body 100*p* of a conventional feeder, as is known from the state of the art.

The main body 100*p* is of integral and U-shaped design and can be mounted on the end faces (top right and bottom left in the figure) only on end plates 120*p*, 120*p*' (FIG. 2). Two guide rails 130*p*, 130*p*', which are fastened to the main body 100*p* along the longitudinal direction of the main body 100*p*, are likewise illustrated. The longitudinal direction F of the main body 100*p* corresponds to the conveying direction F of the strip material.

The conveying direction F is fixedly defined in conventional feeders due to the construction of the components (inter alia due to the construction of the main body 100*p*) and cannot be changed. This is illustrated in the figures by the arrow F with only one tip.

Figure 2A:
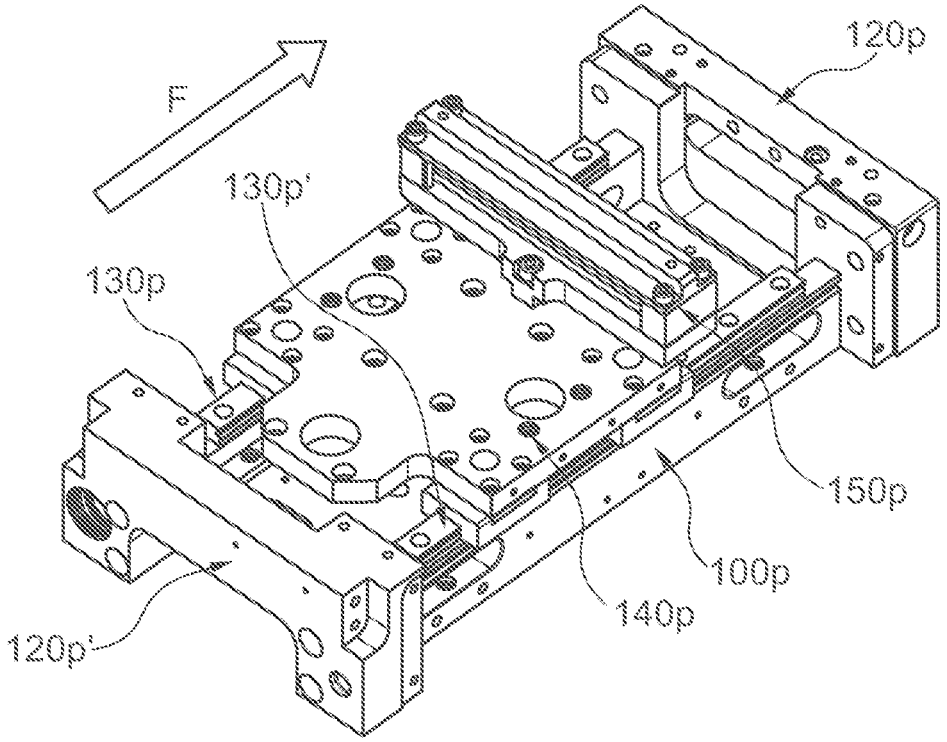
Fig. 2a (prior art)
FIG. 2*a* shows the conventional base body from FIG. 2 with further components of a conventional feeder, as is known from the state of the art.

FIG. 2*a* shows the conventional main body 100*p* from FIG. 2 with further components of a conventional feeder, as is known from the state of the art. A carriage plate 140*p* and a holding device 150*p* are additionally illustrated.

The end plates 120*p*, 120*p*' are of different designs. The first end plate 120*p*' is configured to accommodate strip material on a first side of the main body 100*p* with a corresponding holding device (not illustrated). The second end plate 120*p* is configured to feed the strip material to a sequential cutting tool on a second side of the main body 100*p* (optionally with a corresponding holding device). In addition, substantially no fastening holes are provided over the outer circumferential surface of the end plates 120*p*, 120*p*'.

Figure 2B:
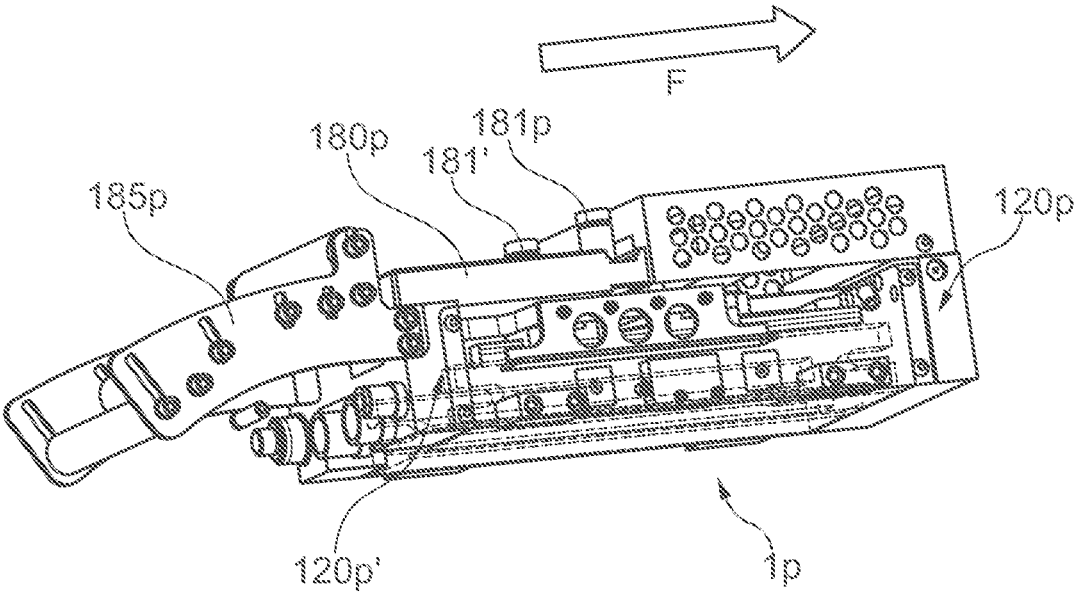
Fig. 2b (prior art)
FIG. 2*b* shows a conventional feeder with the conventional components from FIG. 2*a* and with further components, as is known from the state of the art.

FIG. 2*b* shows a conventional feeder 1*p* with the conventional components from FIG. 2*a* and with further components, as is known from the state of the art. As described above, it can also be seen in this figure that the conveying direction is structurally fixedly predefined. In addition, a support plate 180*p* (for the workpiece) and guide rollers 181*p*, 181*p*' for introducing the workpiece can be seen. In addition, a roller basket 185*p* is shown.

Figure 3:
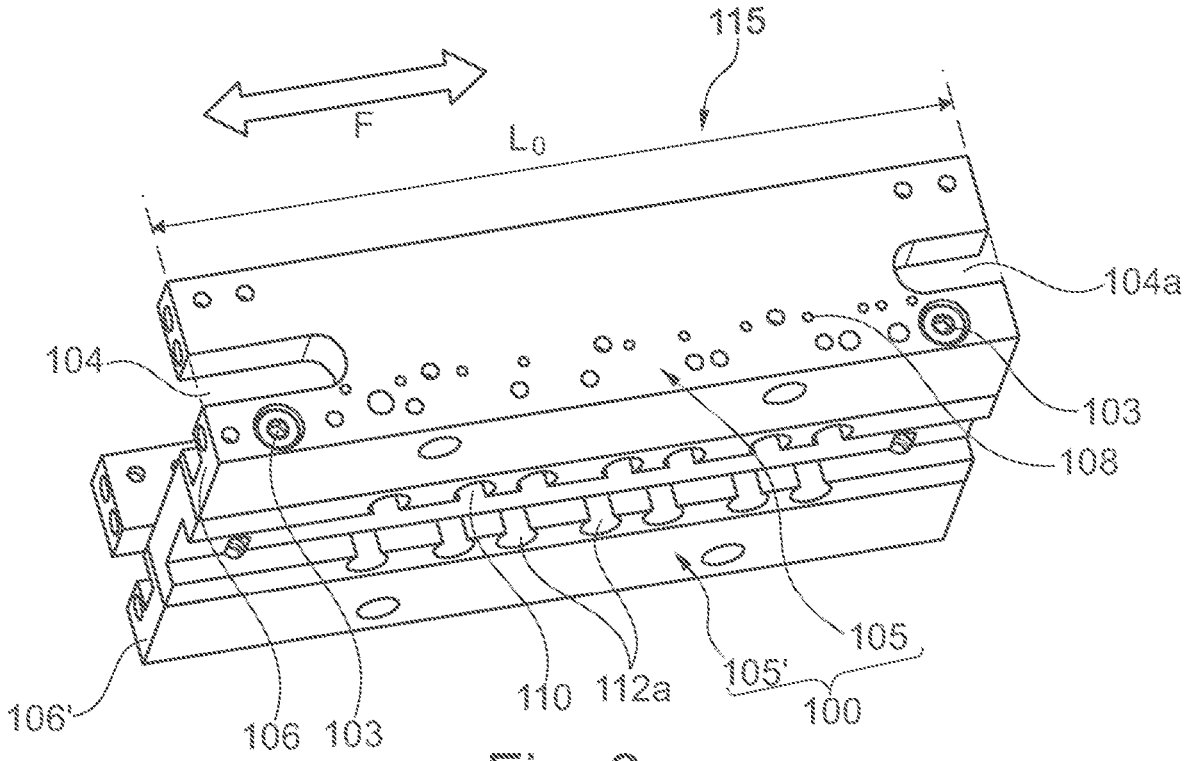
FIG. 3 shows a support structure according to an embodiment of the present invention.

FIG. 3 shows a pair of side support modules 100 with a base support module 110, which form a U-shaped support structure 115 of a feeder according to an embodiment of the present invention.

The support structure 115 is of multi-part design and comprises a first side support module 105 and a second side support module 105'. Both side support modules are similar (as described herein). A base support module 110, to which the two side support modules 105, 105' are detachably connected, is arranged between the two side support modules.

For fastening, first mounting means 103, in particular two fastening holes 103, are provided on both side support modules 105, 105', preferably at two opposite end regions in the longitudinal direction F of the pair of side support modules 100/of the base support module 110. For example, screws can be introduced through the fastening holes 103, which screws come into engagement with the base support module 110. In this way, a sufficiently stable fastening can be ensured. The side support elements 105, 105' can also be detachably connected to one another exchangeably with the base support module 110.

The figure further shows a length Lo of the pair of side support modules. The length is preferably 110 to 150 mm, most preferably 120 to 140 mm or even 130 mm. In this example, the length of the base support module 110 likewise corresponds to the length Lo (since only one pair of side support modules 100 is comprised).

A side support module 105, 105' respectively has a U-shaped recess 140, 140*a* at both end faces 106. The legs of the U-shaped recess 140, 140*a* are arranged parallel to the conveying direction F. Cables and/or hoses (e.g., pneumatic hoses) can be guided through these recesses 140, 140*a* from the inside of the feeder to the outside and/or vice versa. This offers the advantage that the cables and/or hoses can already be connected at both ends, and subsequently inserted laterally through the recess 140, 140*a*. In conventional feeders, the cables and/or hoses have to be introduced through circumferentially closed openings (to be seen in FIGS. 1, 2 and 3 through the oval openings in the lateral walls).

A side support module 105, 105' further has a plurality of threaded bores 108 at the lateral outer face (outside, since not directed toward the inside of the U-shaped support structure 115). These threaded bores 108 are arranged at regular intervals and serve to fasten further components of the feeder. In this way, a sensor, for example a linear sensor, can be detachably connected to the side support module 105, 105' at flexible (axial) intervals (this is indicated in FIG. 10). It can be seen that the right recess 104*a* is somewhat shorter in the longitudinal direction than the left recess 140. A sensor can thus be arranged more toward the side of the right recess 140*a*, for example.

The base support module 110 has a plurality of second mounting means (e.g., fastening holes) 112*a*. Two fastening holes 112*a* are indicated by way of example in FIGS. 3 and 4*a*. The second mounting means 112*a* are arranged in pairs at (regular) intervals along the conveying direction F. These serve to detachably connect a drive unit 170 (FIG. 6) to the base support module 110 at flexible (axial) intervals.

Figure 4:
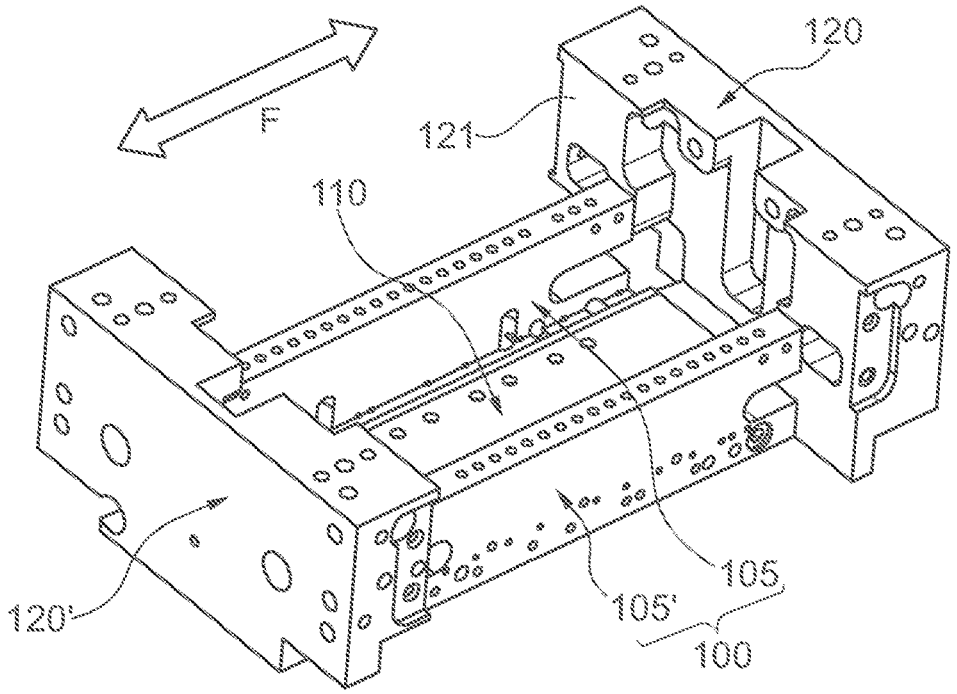
FIG. 4 shows the support structure from FIG. 3 with further components of a feeder according to an embodiment of the present invention.

FIG. 4 shows the support structure and the pair of side support modules 100 from FIG. 3 with further components of a feeder according to an embodiment of the present invention.

In addition to the components illustrated in FIG. 3, a first 120 and a second 120' similar end plate 120, 120' are illustrated. The end plates 120, 120' are fastened to a first and a second end of the pair of side support modules 100, or to opposite sides of the U-shaped support structure 115 in the longitudinal direction F.

As can be seen on the basis of the figure, the end plates 120, 120' have a plurality of fastening holes in comparison with conventional end plates 120*p* (FIGS. 1, 2). In particular, this plurality of fastening holes is distributed substantially over the entire outer surface of the end plates (in part symmetrically). This makes possible a flexible and modular design of the end plates 120, 120'.

Figure 4A:
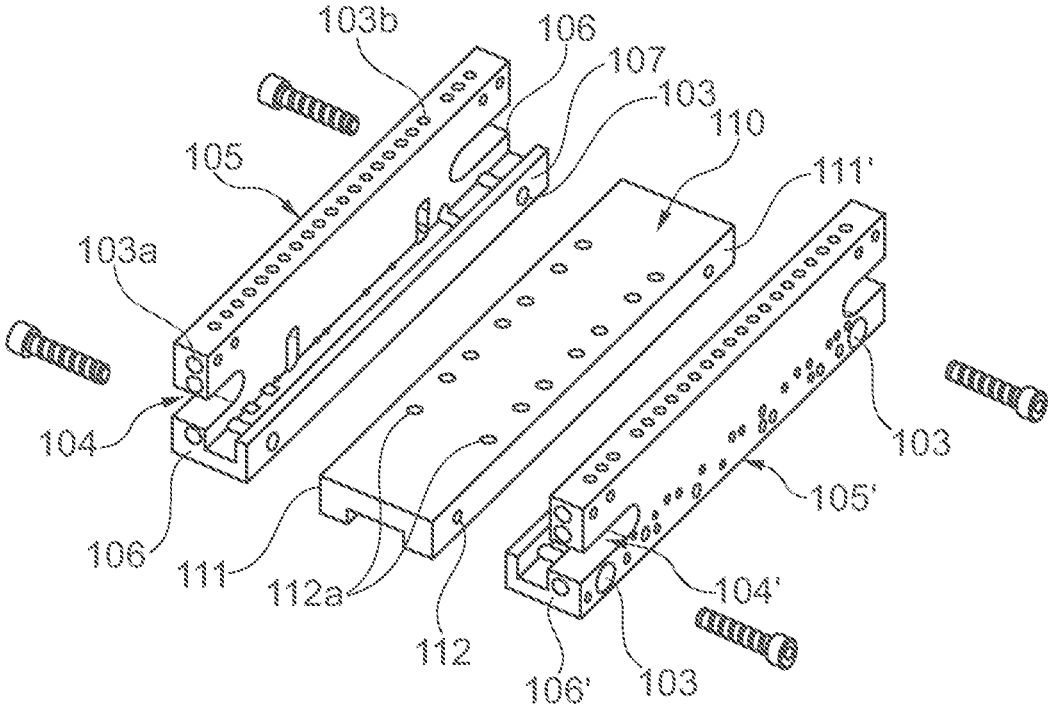
FIG. 4*a* shows FIG. 3 in an exploded view.

FIG. 4*a* shows two side support modules 105, 105' of a pair of side support modules 100, 100*a*, 100*b* and a base support module 110 in an exploded view.

Two end faces 106, 106' of the side support module 105 are shown at opposite ends (in the longitudinal direction) of the side support module 105, to which two end plates 120 (not illustrated) can be detachably mounted. An end plate and a side support module 105 of a further pair of side support modules 100*a* can also be detachably mounted/or arranged on the end faces 106, 106'. Two side support modules of two further pairs of side support modules 100*a*, 100*b* can also be arranged on the end faces 106, 106'. The end faces are thus configured for at least two functions.

The side support modules 105, 105' have second mounting means 103*a* at their end faces 106, 106' (indicated only at one end face 106 of a side support element 105 in the figure). These are configured for the detachable connection to the end plate. For the second function of the end faces 106, the end faces are of planar design in order to be able to be flush with each other. In addition, the U-shaped recesses 140, 140*a* are designed such that they form a continuous termination (without jumps) when side support modules are arranged in a sequence in the longitudinal direction.

The side support modules 105, 105' are elongated and substantially form a U-shaped profile with legs of different lengths (the inwardly directed leg is quite short). The smaller leg of each side support module is substantially flush with the inwardly directed surface 107 with the base support module 110, in particular with the surface 111, 111'.

The two side support modules 105, 105' can be detachably mounted on the side surface 107 with the base support module 110 via the sides 111, 111'. For this purpose, the base support module 110 has first mounting means 112 on both sides in, 111' arranged transversely to the conveying direction, which are configured for force-fitting connection to the first mounting means 103 of the side support modules 105, 105'.

The side support modules 105, 105' further have third mounting means 103*b*. With these, a guide rail 130 (FIG. 5) can be detachably connected to a side support module 105. The third mounting means 103*b* are present in a plurality and thus make possible a flexible fastening of the guide rail. The guide rail 130 and the third mounting means 103*b* of the side support modules 105, 105' are configured such that the guide rail 130 can be connected to a plurality of side support modules 105, 105' of pairs of side support modules 100, 100*a*, 100*b* arranged in the conveying direction at the same time (FIGS. 7*a*, 7*b*).

Figure 4B:
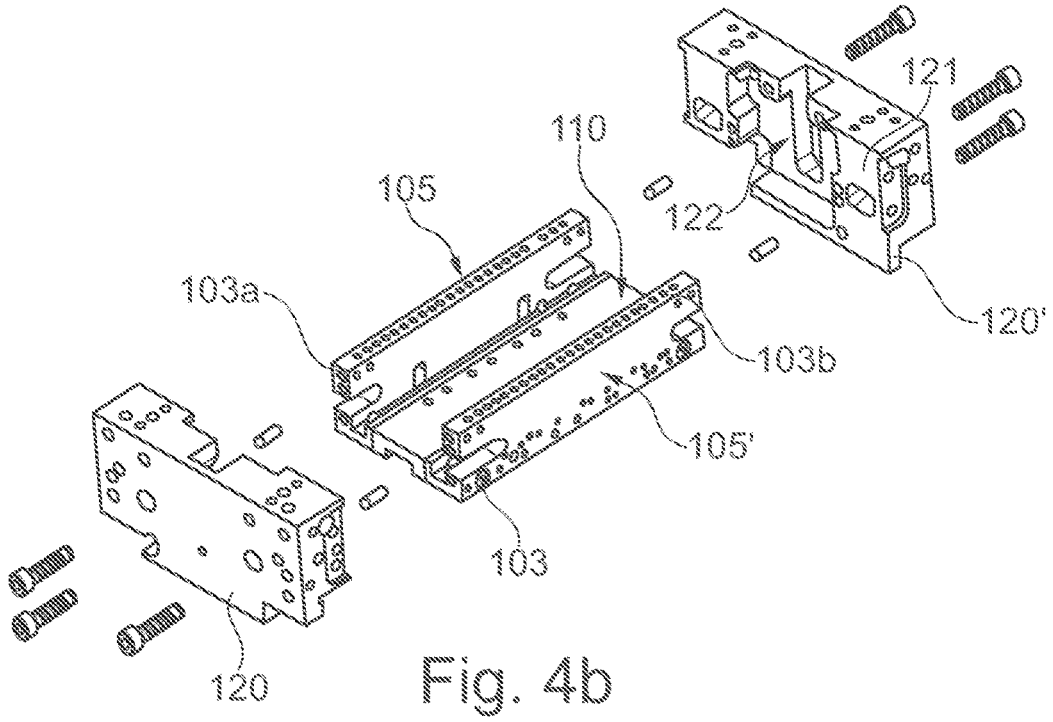
FIG. 4*b* shows FIG. 4 in an exploded view.

FIG. 4*b* shows FIG. 4 in an exploded view.

The figure shows a recess 122 of the end plate 120' along the conveying direction (the same applies to the end plate 120), which is arranged substantially in the center of the end plate 120'. This recess 122 is configured to at least partially receive the conveying module (for example the carriage plate 140, holding device 150 and/or a magnetic rail 160) during operation of the feeder (cf. FIGS. 5, 8). An enlarged path length of the carriage plate is consequently made possible.

The figure further shows the connection of the second mounting means 103*a* at the end faces of the side support modules 105, 105' to the end plates 120. The connection can take place via pins and/or screws.

Figure 5:
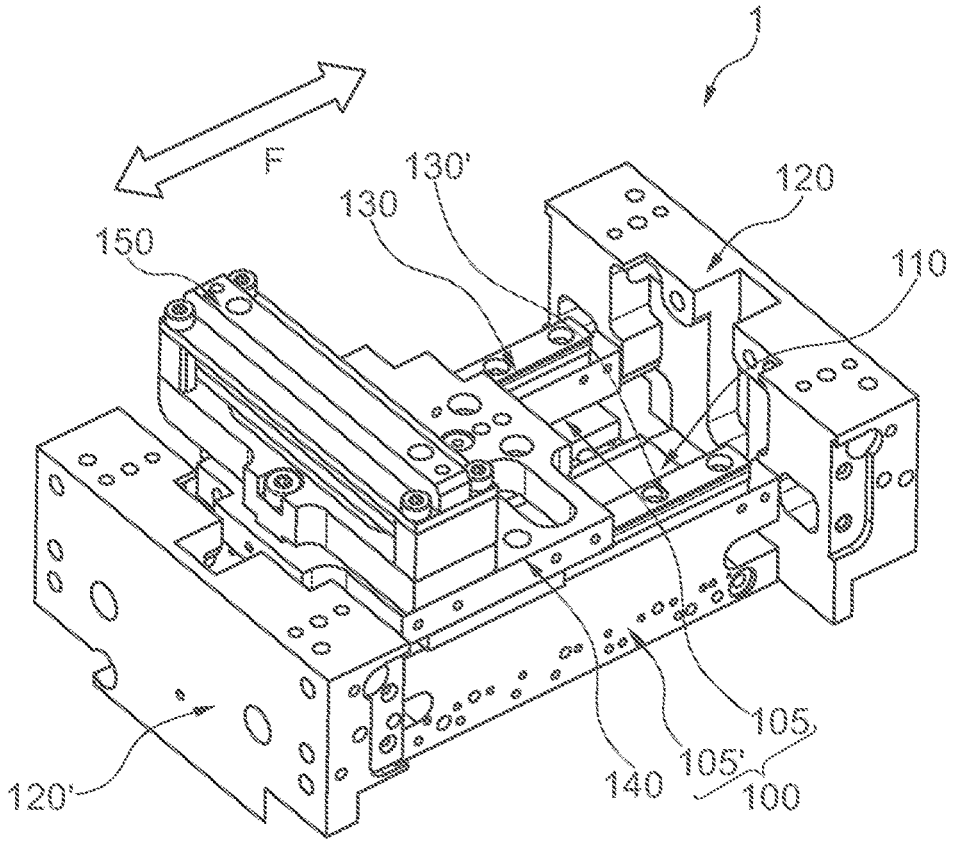
FIG. 5 shows the support structure from FIG. 4 with further components of a feeder according to an embodiment of the present invention.

FIG. 5 shows the support structure from FIG. 4 with further components of a feeder according to an embodiment of the present invention. A carriage plate 140 (which is comprised by the conveying module) is illustrated, which is configured to be moved between the two end plates 120, 120'. In particular, the carriage plate 140 is moved on and along the guide rails 130, 130', which are fastened to the side support modules 105, 105' along the longitudinal direction of the pair of side support modules 100.

The conveying direction F can be oriented in both directions, illustrated on the basis of the arrows, by the configuration of the feeder components using the same feeder components. For example, the same support plate 180 (FIG. 6) can be detachably fastened on the right and the left end plate 120, 120'. For this purpose, the support plates 180 and the end plate 120, 120' have fastening means which are congruent to one another in order to be able to detachably mount the components to one another.

Figure 6:
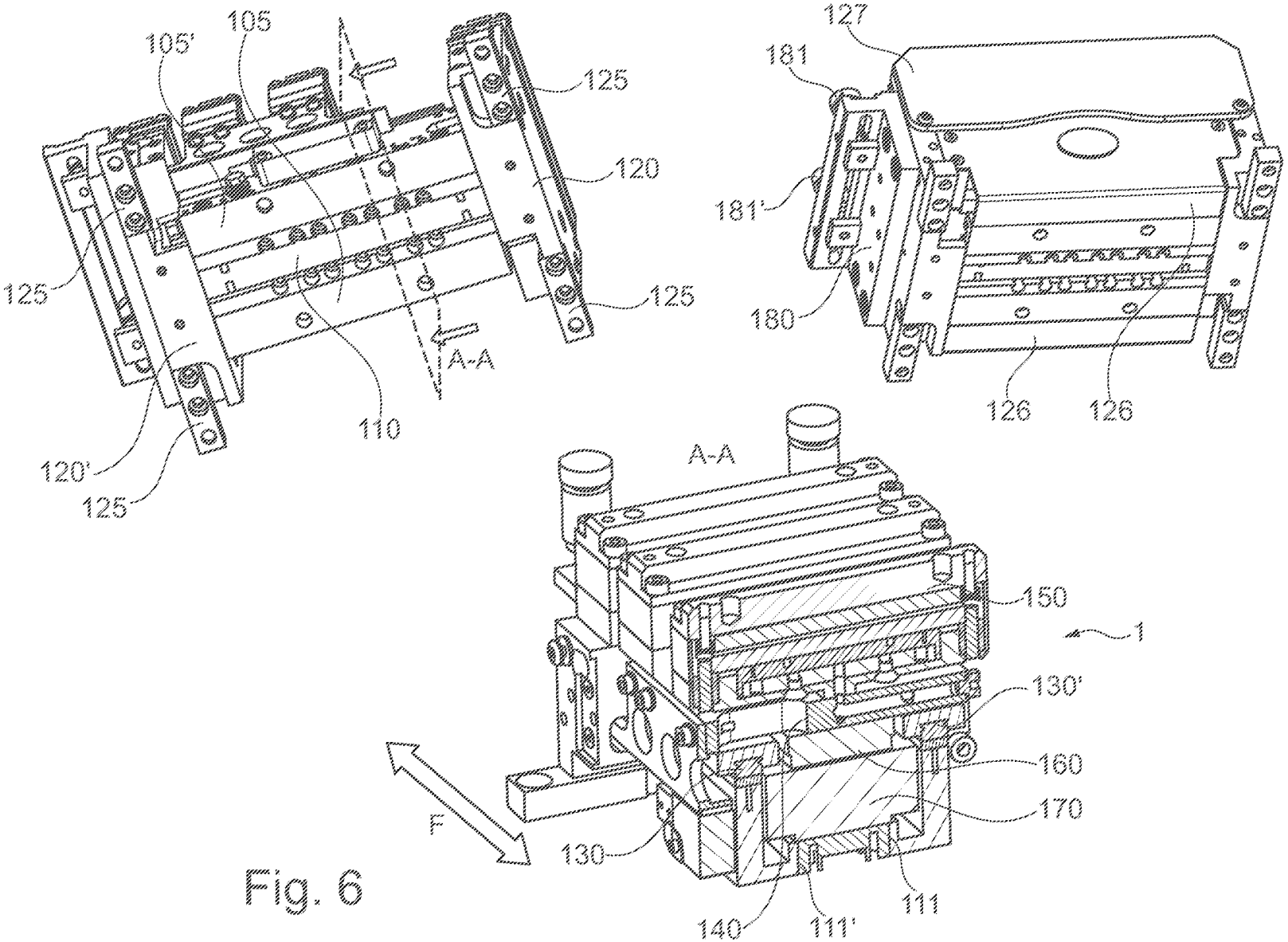
FIG. 6 shows a feeder with the components from FIG. 5 and with further components of a feeder according to an embodiment of the present invention.

FIG. 6 shows a feeder 1 with the components from FIG. 5 and with further components of a feeder 1 according to an embodiment of the present invention. Three perspective views of the feeder 1 are illustrated.

A view from below is illustrated at the top left in this figure so that substantially a rear side of the feeder can be seen. During operation of the feeder 1, in this embodiment the visible surfaces of the base support module 110, of the side support modules 105, 105', of the end plates 120, 120' and of the mounting feet 125 would stand substantially on the base. Four mounting feet 125 are illustrated, which each project perpendicularly outward from the two end plates 120, 120' and are detachably mounted on the end plates 120, 120'.

A similar perspective view from obliquely below is illustrated at the top right in this figure. Further optional lateral cover plates 126 and an optional upper cover plate 127 are shown herein. In addition, the support plate 180 comprising two guide rollers 181, 181' is illustrated.

A perspective sectional illustration of the plane A-A (indicated at the top left in the figure) is illustrated at the bottom in this figure. In this way, the arrangement of the carriage plate 140, of the magnetic rail 160, of the drive unit 170 and of the side support modules 105, 105' and of the base support module 110 can be seen. The drive unit 170 is laterally (sideways) bounded by the side support modules 105, 105' and is detachably mounted on the base support module 110 (via second mounting means 112*a* of the base support module 110). The magnetic rail 160 is detachably mounted on the carriage plate 140. Likewise, the holding devices 150 are detachably mounted with the carriage plate (from above). A plurality of optional holding devices 150 are illustrated.

During operation of the feeder 1, the drive unit 170 is spatially fixed and drives the magnetic rail 160, which moves along the guide rails 130, 130' and thus also moves the carriage plate 140 and the holding devices 150. The components movable together can be regarded as a conveying module. The view according to the lower illustration of the feeder 1 in this figure corresponds to a usual orientation when the feeder is in operation. In addition, the conveying directions F for the feeder 1 are illustrated for this view.

Figure 7:
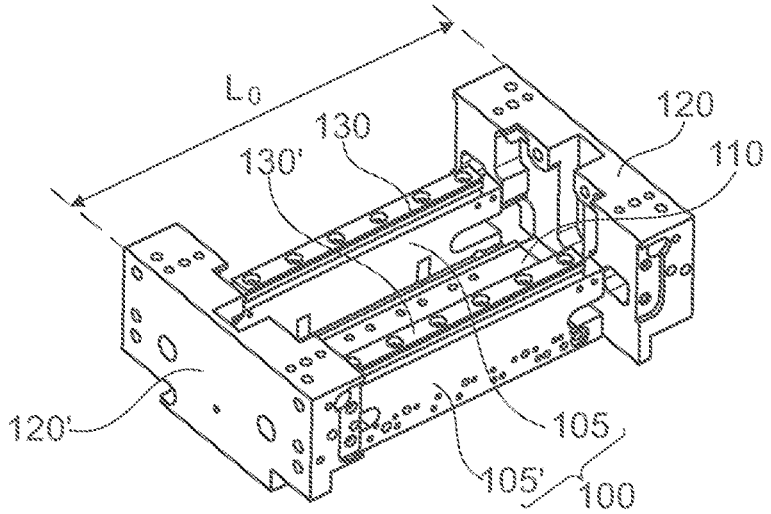
FIG. 7 shows the support structure from FIG. 4 with further components of a feeder according to an embodiment of the present invention.
Figure 7A:
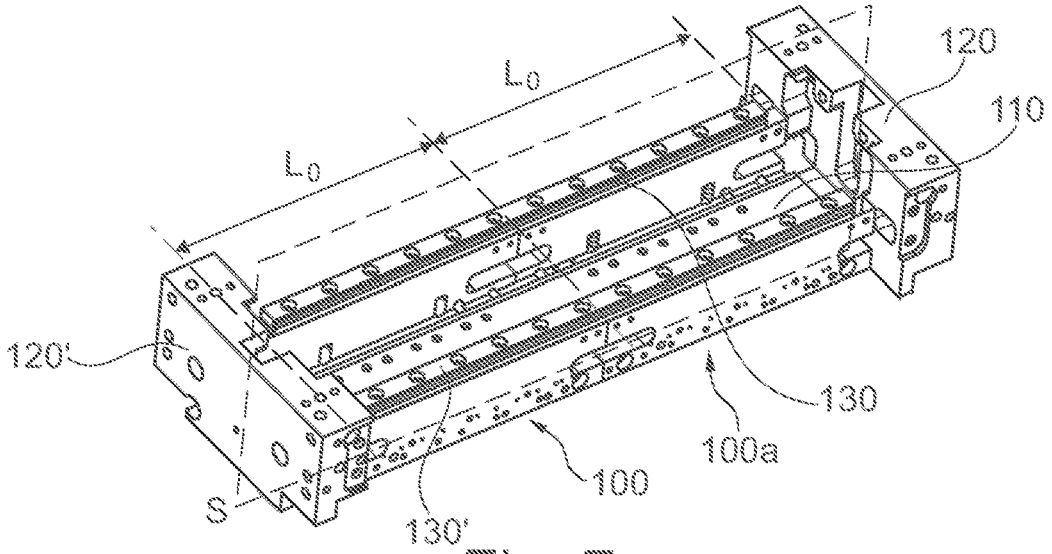
FIG. 7*a* shows the embodiments of FIG. 7, wherein the support structure comprises a further pair of side support modules according to an embodiment of the present invention.
Figure 7B:
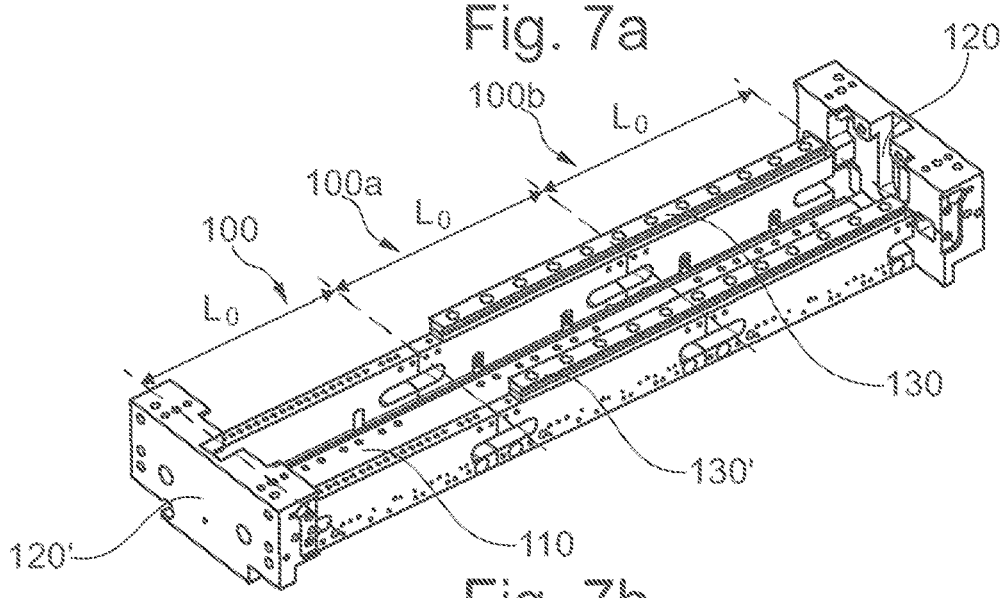
FIG. 7*b* shows the embodiments of FIG. 7*a*, wherein the support structure comprises a further pair of side support modules according to an embodiment of the present invention.

FIG. 7 shows the support structure and the pair of side support modules 100 from FIG. 4 with further components of a feeder according to an embodiment of the present invention. Compared to FIG. 4, the guide rails 130, 130' are also illustrated herein, which are detachably connected on the pair of side support modules 100 or respectively on the first 105 and the second 105' side support module.

The pair of side support modules 100 represents a part of the U-shaped support structure. As described herein, the side support modules 105, 105' are configured to correspondingly form one or more feeders with different lengths by a sequence of one or more pairs of side support modules 100, 100*a*, 100*b*. This is illustrated in particular in the comparison of FIGS. 7, 7*a* and 7*b*.

FIG. 7*a* shows the embodiments of FIG. 7, wherein a further pair of side support modules 100*a* is comprised according to an embodiment of the present invention. For reasons of clarity, the side support modules 105, 105' are not indicated separately in this figure, but rather only the pairs of side support modules 100, 100*a*.

A plane S is indicated by the dashed quadrangle. A part of the illustrated components of the feeder is symmetrical with respect to the plane S. Likewise, the mounting means described herein are at least partially symmetrical with respect to the plane S. This applies for example to the first mounting means 103 of the side support modules 105, 105'.

FIG. 7*b* shows the embodiments of FIG. 7*a*, wherein a further pair of side support modules 100*b* is comprised according to an embodiment of the present invention.

The length Lo of the pair of side support modules (this corresponds to the length of a side support module) 100, 100*a*, 100*b* is the same, as described herein. FIG. 7 consequently shows a feeder with a length of approximately 130 mm. FIG. 7*a* shows a feeder with a length of approximately 260 mm. FIG. 7*b* shows a feeder with a length of approximately 390 mm. The end plates 120, 120' are similar (identical) in all embodiments FIGS. 7, 7*a* and 7*b*.

The end plate 120 is detachably mounted by means of its front face 121 (the reference sign is illustrated in FIGS. 4 and 4*b*) to the end faces 106, 106' (the reference signs are illustrated in FIGS. 3 and 4*a*) of the pair of side support modules 100*b*. The pair of side support modules 100*b* is detachably mounted on the inwardly directed side surfaces 107, 107' (the reference signs are illustrated in FIG. 4*a*) with the base support module 110 (on a surface 111, 111' facing the plane S, cf. FIG. 7*a*, the reference signs are illustrated in FIGS. 4*a* and 6) and arranged on the pair of side support modules 100*a* (on end faces 106, 106' of the pairs of side support modules 100*b*, low).

The same applies to the remaining pairs of side support modules: the pair of side support modules 100*a* is detachably arranged with the base support module 110 (on a surface 111, 111' facing the plane S, cf. FIG. 7*a*) and on the pair of side support modules 100 (on end faces 106, 106' of the pairs of side support modules 100*a*, 100). The pair of side support modules 100 is detachably mounted with the base support module 110 (on a surface 111, 111' facing the plane S, cf. FIG. 7*a*) and with the end plate 120' (on end faces 106, 106' of the pair of side support modules 100). It is advantageous that different feeders can be formed in this way flexibly, quickly and cost-efficiently using similar components.

It can be seen in FIGS. 7, 7*a* and 7*b* that two side support modules 105, 105' are formed to form a pair of side support modules 100, wherein the base support module 110 is arranged in between. The pair of side support modules 105, 105' substantially forms a U-shaped support structure with the base support module 110 and provides stability of the feeder.

It can further be seen that, in the case of a plurality of pairs of side support modules (for example 2, 3 or more), the side support modules 105, 105' are arranged in the assembly in pairs by the individual intermediate base support module 110 at right angles to the conveying direction and in rows along their longitudinal direction on end faces. Consequently, two rows are formed. The rows (the first row formed from one, two or three of the side support module 105, the second row formed from one, two or three of the side support module 105') are detachably mounted with the base support module no, as described herein.

The base support module 110 is of one-piece design in each feeder and has a length matching the respective length of the support structure (1×Lo, 2×Lo, or 3×Lo). This increases the stability of the feeder.

The guide rails 130, 130' are not illustrated continuously in FIG. 7*b* merely for illustration. It is understood that the guide rails 130, 130' extend from the first 120 to the second 120' end plate and in some cases even contact these.

Figure 8:
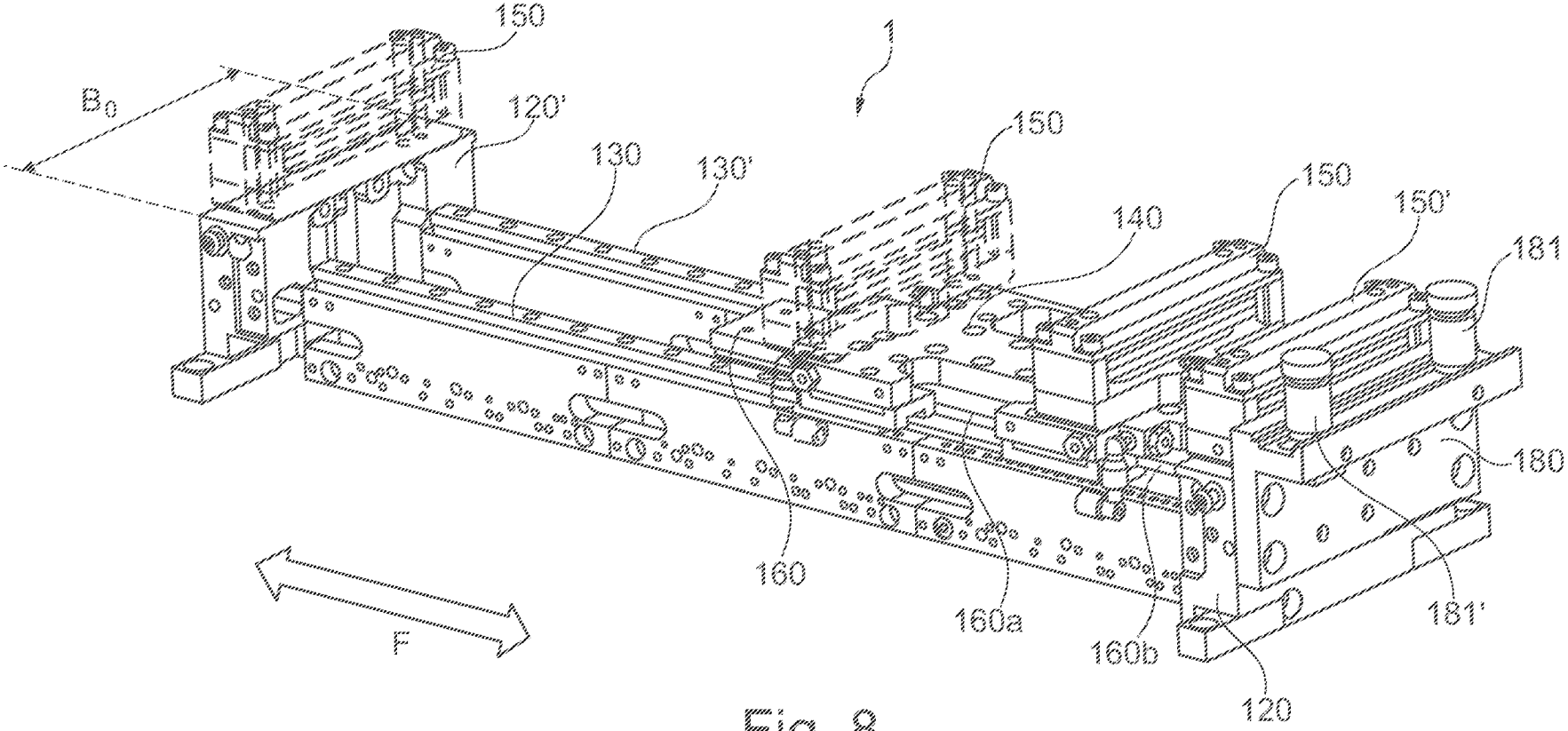
FIG. 8 shows the embodiments of FIG. 7*b* with further components of a feeder according to an embodiment of the present invention.

FIG. 8 shows the embodiments of FIG. 7*b* with further components of a feeder according to an embodiment of the present invention. In comparison with FIG. 7*b*, a carriage plate 140 can be seen herein, on which a movable holding device 150 is detachably mounted. The carriage plate 140 is configured movably along the conveying direction F. A second movable holding device 150, which can optionally be comprised by the feeder, is also indicated by dashed lines. For example, the second movable holding device can improve the guiding of strip material. However, the dashed movable holding device 150 likewise means that only one movable holding device is provided at the dashed position. The position in the longitudinal direction is variable due to the carriage plate 140.

In addition, the figure shows a support plate 180 configured to be fastened to both end plates 120, 120'. An embodiment is illustrated in which the support plate 180 is arranged only at one end of the feeder (right). The conveying direction F can be oriented in both directions, illustrated on the basis of the arrows, by the structural configuration of the feeder components using the same feeder components. With the illustrated arrangement of the support plate 180, the conveying direction F is oriented to the left in the figure.

The support plate 180 comprises two guide rollers 181, 181' configured to guide the strip material and feed it to the fixed holding device 150' and then feed it to the movable holding device 150 fastened on the carriage plate 140 (and optionally feed it to a further movable holding device 150).

Three similar magnetic rails 160, 160*a*, 160*b* are illustrated, which are fastened adjacent to each other in the longitudinal direction (in the conveying direction F) with the carriage plate 140 and consequently move with the carriage plate 140.

The carriage plate 140 is driven via a drive unit 170 (not illustrated in this figure). The drive unit 170 is arranged between two side support modules 105, 105' of a pair of side support modules 100, 100*a*, 100*b* and above the base support module 110 (facing away from the web of the U-shaped profile of the support structure toward the opening of the U-shaped profile). Preferably, the drive unit 170 is a linear motor. The electric winding is usually spatially fixed and causes a movement of the magnetic rails 160, 160*a*, 160*b* (these can comprise a permanent magnet) by the electric current flow.

In some embodiments herein, an enlarged overlap region of the drive unit 170 and the magnetic rails in the conveying direction F can be achieved compared to conventional designs of feeders. This improves the efficiency of the movement. In addition, the arrangement offers the advantage that the weight ratio of the magnetic rails 160, 160*a*, 106*b* to the drive unit 170 is low and therefore a low mass has to be accelerated.

In some cases, in particular if longer travel paths of the carriage plate 140 are necessary, it can be expedient to fasten the drive unit to the carriage plate 140 and the magnetic rail to the pair of side support modules/the base support module (for example in order to ensure an overlap region). In such cases, a cable drag can be provided in order to guide, for example, a power cable of the drive unit 170 (the drive unit 170 would in such cases move at each stroke).

In the embodiments of FIGS. 3 to 8, the width B0 of the end plate 120 (and of the identical end plate 120') is approximately 70 mm to 150 mm, preferably 90 mm to 140 mm, further preferably 100 mm to 125 mm, most preferably 110 mm to 115 mm or even 112 mm. This width can also correspond to an installation width of the feeders. It can be that the mounting feet 125 project laterally somewhat further over the width of the end plate 120. The width of the holding devices 150 is approximately 98 mm. However, wider holding devices 150 can also be provided, depending on the use case.

The guide rails 130, 130' are not illustrated continuously in this figure merely for illustration. It is understood that the guide rails 130, 130' extend from the first 120 to the second 120' end plate and in some cases even contact these.

Even if not illustrated separately in the figure, the feeder 1 can also comprise a roller basket which is configured such that it can be flexibly mounted to, for example, an end plate 180.

In the embodiments shown so far, the passage width of the holding devices 150, 150' is approximately 60 mm to 120 mm, preferably 65 mm to 95 mm, further preferably 70 mm to 90 mm, most preferably 75 mm to 85 mm or even 80 mm.

Figure 9:
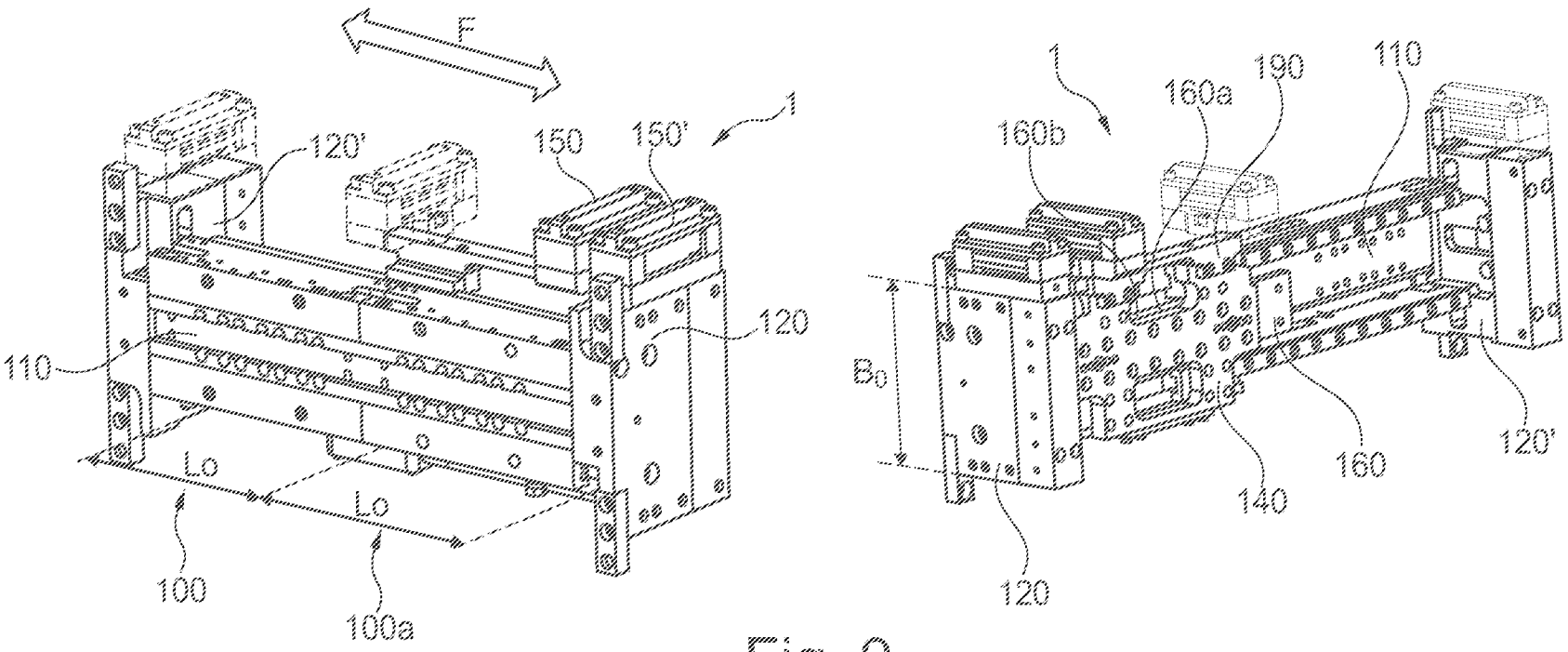
FIG. 9 shows a rotated feeder according to two embodiments of the present invention.

FIG. 9 shows a feeder 1 with two 100, 100*a* (left) and a feeder 1 with three 100, 100*a*, 100*b* (right) pairs of side support modules according to two embodiments of the present invention.

With respect to the pairs of side support modules 100, 100*a*, 100*b* of the conveying direction F, of the base support module 110, and with respect to the other components (even if not explicitly mentioned), the description set forth herein applies, if technically meaningful. In addition, it goes without saying that an embodiment of a feeder 1 with only one pair of side support modules 100 is likewise possible and encompassed by the invention. For reasons of clarity, in the right embodiment of FIG. 9 the reference signs for the three pairs of side support modules 100, 100*a*, 100*b* have been omitted (in the left embodiment the two pairs of side support modules 100, 100*a* are indicated together with their length Lo). The base support module 110 of the left embodiment has a length of 2×Lo, the base support module 110 of the right embodiment has a length of 3×Lo.

FIG. 9 shows at least one conveying module (comprises the carriage plate 140, the magnetic rails 160, 160*a*, 160*b* and the holding device 150) arranged on the U-shaped support structure movably in the conveying direction F. The holding device 150 is elongate, wherein the longitudinal axis of the holding device 150 extends substantially parallel to the normal of the carriage plate 140. The magnetic rails 160, 160*a*, 160*b* are planar and connected to the carriage plate 140 such that their normals run substantially parallel (in the right view, the normal is shown obliquely to the right towards the observer).

The end plate 120 of this embodiment is identical to the above-described end plates 120, 120'. Consequently, the width B0 of the end plate 120 in the embodiment shown in this figure (also referred to as "rotated" embodiment) corresponds to a height. The dimension B0 drawn in this figure corresponds to a second dimension extending substantially at right angles to the normal of the carriage plate 140 and to the conveying direction F. The end plates 120 also have a first dimension along the normal of the carriage plate 140.

For example, the horizontal/lying embodiments of the feeders have a height (viewed vertically in FIG. 8) of approximately 94 mm including holding devices 150 (approximately 102 mm including cover plates). The height of the end plate 120 is approximately 58 mm. This height also applies to a wider embodiment of the horizontal/lying feeders (cf. FIG. 12). The width of the rotated embodiments is oriented to the heights of the horizontal/lying embodiments and is consequently substantially narrower than the width of the horizontal/lying embodiments. The height of the rotated embodiments (measured in the direction B0 in FIG. 9) is approximately 148 mm including holding devices 150 (approximately 156 mm including cover plates).

In the rotated embodiments of the feeders, the above-described feeders are rotated by approximately 90° (or by approximately −90° or the like) and the holding devices 150, 150' are detachably mounted on a narrow side of the feeder.

It is advantageous that the components of the feeder are equal components of the other embodiments described herein due to their modular nature. This applies in particular to the pairs of side support modules 100, 100*a*, 100*b*, the base support module 110, the carriage plate 140, the end plate 120, the guide rail(s) 130, the magnetic rail(s) 160, the drive unit 170, and the not separately indicated guide carriages, which are guided on the guide rails 130, 130'. Consequently, the modular components can be produced in larger numbers and assembled flexibly.

A further advantage of the rotated embodiment is that the feeder can be fastened to a wall with the lower surface of the base support module 110, of the pair of side support modules 100, 100*a*, 100*b*, of the end plates 120 and/or of the mounting feet (the "lower surface" can be seen in the left view of this figure).

Advantageously, only holding devices 150 with a smaller passage width are used, for example in the range between approximately 20 mm to 60 mm, preferably 30 mm to 50 mm, further preferably 35 mm to 45 mm, most preferably 38 mm to 42 mm or even 40 mm. The holding devices are thus adapted according to the intended feeder application and promote the space advantage created by the rotation.

With reference to FIG. 4, it has been explained that the end plates 120, 120' have a plurality of fastening holes. This promotes that a further operation of the feeder after a rotation can be ensured in a simple manner. Thus, in the rotated condition, a fastening of holding devices 150 to a surface of the end plate 120 directed upward in the rotated condition (which is illustrated directed to one side in FIG. 4) can advantageously be made possible.

The carriage plate 140 and the movable holding device 150 are configured such that the holding device 150 can be detachably connected in a first orientation to an upper side of the carriage plate 140 (cf. FIG. 8) and in a second orientation to an outer side of the carriage plate 140 (cf. FIG. 9). A gripper plate 190 can be comprised by the feeder, which is detachably mounted with the carriage plate 140 and receives the holding device 150. No rebuilding of the carriage plate 140 is thus necessary.

FIG. 10 shows a feeder with two drive units 170, 170' and two pairs of side support modules 100, 100*a* according to an embodiment of the present invention in a first position of the carriage plates (left) and a second position of the carriage plates (right).

With respect to the pairs of side support modules 100, 100*a* of the conveying direction F, of the base support module 110, and with respect to the other components (even if not explicitly mentioned), the description set forth herein applies, if technically meaningful. In addition, it goes without saying that an embodiment of a feeder 1 with only one pair of side support modules 100 or with three 100, 100*a*, 100*b* pairs of side support modules is likewise possible.

For reasons of clarity, in the left view the reference signs for the pairs of side support modules 100, 100*a* are not illustrated (in the right view the two pairs of side support modules 100, 100*a* are indicated together with their length Lo). The base support module 110 has a length of 2×Lo. With respect to the widths of the components (in particular of the end plate 120 and of the holding devices 150, 150'), the description set forth herein to FIGS. 3 to 8 applies.

In the following, the differences from the previous embodiments are substantially discussed.

Two conveying modules which are movable independently of one another are illustrated. The two conveying modules each comprise one of the carriage plates 140, 140' (which are of the same type), and each comprise a holding device 150 (likewise of the same type), which are detachably connected to the respective carriage plates 140, 140'. In addition, two drive units 170, 170' are detachably mounted with the base support module 110 (not indicated separately in the figure, but as described herein). In addition, magnetic rails 160, 160' are detachably mounted on each carriage plate 140, 140'. In addition, two measurement systems which are independent of one another can also be installed.

Each carriage plate 140, 140' can advantageously be controlled individually and travel an individual path along the conveying direction F.

The conveying process of strip material can be understood as follows: In a moved-apart position (cf. right-hand view), the first holding device 150 (in the right-hand view, this would be the left-hand holding device 150) grips the strip material and is subsequently moved translationally/linearly along the conveying direction F up to approximately the center of the feeder 1 via the linear motor 170 (this position of the left-hand holding device 150 is illustrated in the left-hand view). When it reaches the center, the second holding device 150 grips, consequently takes over the control of the strip material and is moved translationally via the linear motor 170' to the other side of the feeder (on the right in the views).

In this embodiment of a feeder with two drive units, no spatially fixed holding devices are required (as are indicated for example in FIG. 9). The strip material is usually held by a gripper, preferably at any time during operation, so that a spatially fixed holding device is not necessary.

Figure 11:
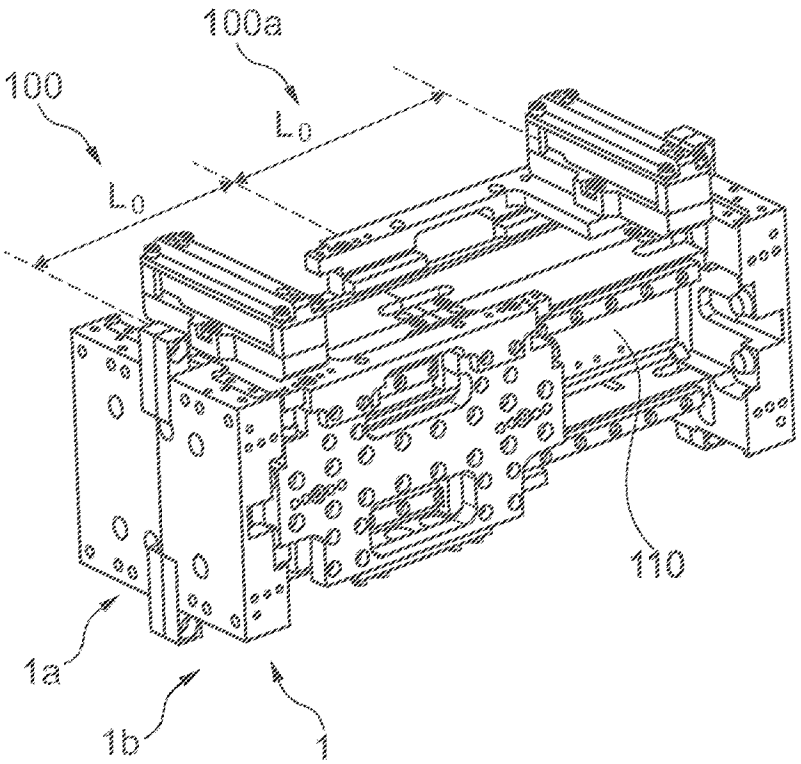
FIG. 11 shows a feeder which is formed from two support structures arranged on one another on the rear side according to an embodiment of the present invention in a first position of the carriage plates (left) and a second position of the carriage plates (right)
Figure 11:
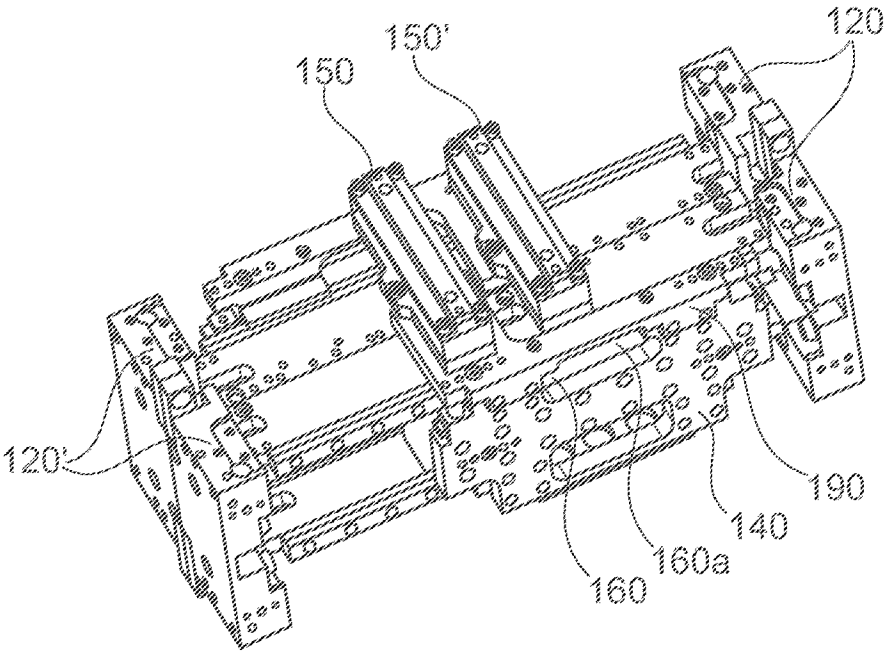

FIG. 11 shows a feeder 1*b* which is formed from two feeders 1, 1*a* arranged on one another on the rear side according to an embodiment of the present invention. A first position of the carriage plates (left) and a second position of the carriage plates (right) are shown.

The two feeders 1, 1*a* arranged on one another on the rear side and detachably mounted to each other are indicated in this figure by the reference signs 1 and is and form the feeder 1*b* when assembled.

With respect to the pairs of side support modules 100, 100*a*, 100*b* of the conveying direction F, of the base support module 110, and with respect to the other components (even if not explicitly mentioned), the description set forth herein applies, if technically meaningful. In addition, it goes without saying that an embodiment of a feeder 1*b* with only one pair of side support modules 100 or with three 100, 100*a*, 100*b* pairs of side support modules is likewise possible and encompassed by the invention. For reasons of clarity, some reference signs have been omitted in the two views. The base support module 110 of the embodiment has a length of 2×Lo. With respect to the widths of the components (in particular of the end plate 120 and of the holding devices 150, 150'), the description set forth herein to FIGS. 3 to 8 applies.

In the following, the differences from the previous embodiments are substantially discussed.

The feeder 1*b* comprises a support structure which is formed along the conveying direction F and a first and a second conveying module (each conveying module comprises in each case a carriage plate 140, a holding device 150 and a gripper plate 190) which are arranged on the support structure so as to be movable in the conveying direction F. It can be seen that the conveying modules can overlap at least partially along the conveying direction F (in the first position, the conveying modules overlap by approximately 50%, in the second position by a somewhat smaller proportion. There are positions in which the conveying modules overlap by 100%).

Each feeder 1, 1*a* comprises an independent base support module 110. Consequently, the feeder 1*b* comprises two base support modules 110. The feeder 1*b* likewise comprises two carriage plates 140 (the front carriage plate 140 of the feeder 1 is indicated only in the left view in the figure). Comparable to the rotated embodiment (FIG. 9), the holding devices 150, 150' are detachably mounted on a narrow side of the feeder. Due to the arrangement of the feeder 1*b*, the carriage plates 140 do not hinder one another in their respective travel paths. In this way, the holding devices 150, 150' can advantageously each move over a length of at least 40%, preferably at least 45%, most preferably at least 50% of the entire travel path (between the two end plates 120' and the two end plates 120).

As in the case of the rotated embodiment, it can also be meaningful in the case of the embodiment in FIG. 11 to provide a gripper plate 190, which is detachably mounted with the carriage plate 140.

The conveying process of strip material/a workpiece is to be understood as similar to that of the embodiment from FIG. 10. It goes without saying, however, that a movable holding device 150, 150' can perform a longer travel path. The guiding of the material thus takes place more safely and more uniformly. It would be conceivable to design the carriage plate 140 in such a way that the movable holding devices 150, 150' can even perform a longer travel path than 50% of the distance between the end plates. This is not necessary, however, since the transfer of the strip material takes place approximately at 50% of the distance between the end plates (50% of the feeder length).

In this embodiment in FIG. 11, likewise (as in the embodiment with two drive units in FIG. 10), no spatially fixed holding devices are required (as are indicated for example in FIG. 9). The strip material is usually held by a gripper, preferably at any time during operation, so that a spatially fixed holding device is not necessary.

The support structures can be in contact over an area of at least 10%, 20% or more on the rear sides. For example, the contact area can be 48.4% (if for example only one pair of side support modules is provided, 1×Lo support structure length).

Examples of Width Variations

With respect to the following embodiments, the description set forth above applies, if this is technically meaningful. In the following, the differences are substantially discussed. For reasons of clarity, not all components are indicated in some figures, but the person skilled in the art understands which components are meant, at least with the aid of the other figures herein.

Figure 12:
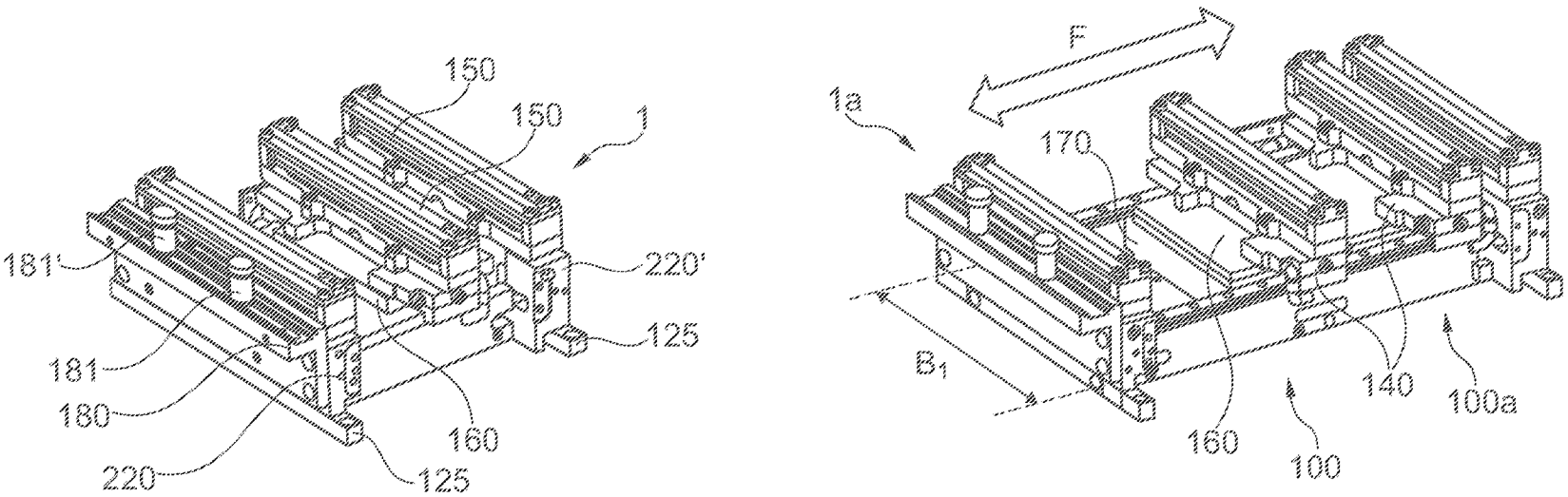
FIG. 12 shows three feeders of different length according to three embodiments of the present invention, wherein the embodiments are similar to FIG. 8 but have a different width.
Figure 12:
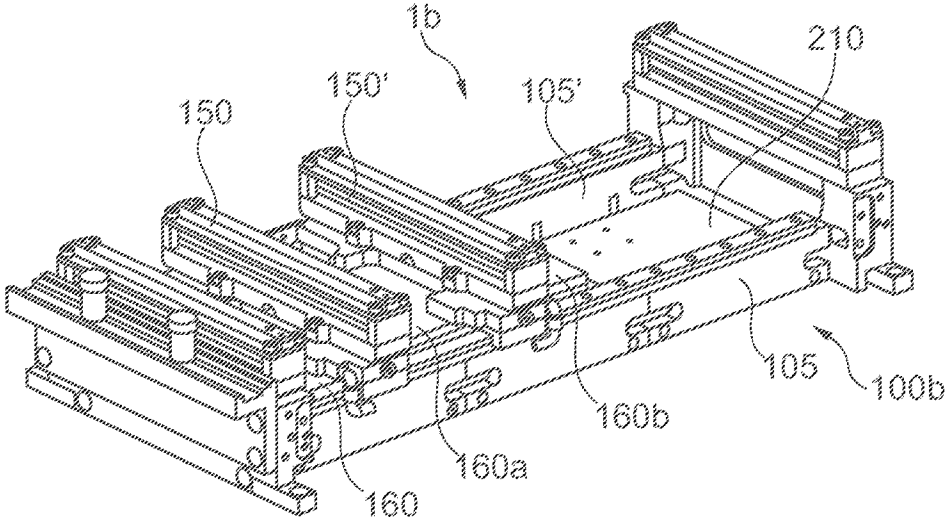

FIG. 12 shows feeders 1, 1*a*, 1*b* of different length according to three embodiments of the present invention, wherein the embodiments are similar to FIG. 8. Compared to the embodiment in FIG. 8, the width of the feeders is changed here.

The feeder 1 has a length of Lo (one pair of side support modules 100). The feeder 1*a* has a length of 2×Lo (two pairs of side support modules 100, 100*a*). The feeder 1*b* has a length of 3×Lo (three pairs of side support modules 100, 100*a*, 100*b*, only 100*b* is indicated for reasons of clarity).

The passage width of the holding devices 150, 150' is approximately 120 mm to 190 mm, preferably 130 mm to 190 mm, further preferably 140 mm to 180 mm, most preferably 150 mm to 170 mm or even 160 mm.

The width B1 of the end plate 220 (and of the identical end plate 220') is approximately 150 mm to 300 mm, preferably 170 mm to 250 mm, further preferably 180 mm to 200 mm, most preferably 190 mm to 195 mm, or even 192 mm. This width can also correspond to an installation width of the feeders 1, 1*a*, 1*b*. It can be that the mounting feet 125 project laterally somewhat further over the width of the end plate 220.

The side support modules 100, 100*a*, 100*b* used are similar to those described herein and consequently correspond to those of the previous embodiments. The base support module 210 is adapted to the widening, the same applies to the magnetic rail 160 and the carriage plates 140. The carriage plates 140 of the three feeders 1, 1*a*, 1*b* shown in FIG. 12 are similar. The same applies to the magnetic rail of the feeder 1 and the three magnetic rails 160, 160*a*, 160*b* of the feeder 1*b*. This is made possible by the modular design of the components and reduces the costs.

The magnetic rail 160 of the feeder 1*a* is more than twice as long as the magnetic rail 160 (the length of which corresponds to that of the magnetic rails 160, 160*a*, 160*b* of the feeder 1*b* due to the similarity) of the feeder 1. In this way, an enlarged overlap between the drive unit 170 and the magnetic rail 160 during the operation of the feeder is can be achieved in the feeder 1*a*. However, the modularity according to the invention makes it possible that, if desired, two similar magnetic rails 160, 160*a* are also used in the feeder 1*a*.

The drive units 170 are likewise similar in all three feeders and a drive unit 170 is used in all three feeders 1, 1*a*, 1*b*. With regard to the embodiments of feeders with a smaller width, the drive units 170 differ only in their width.

Figure 13:
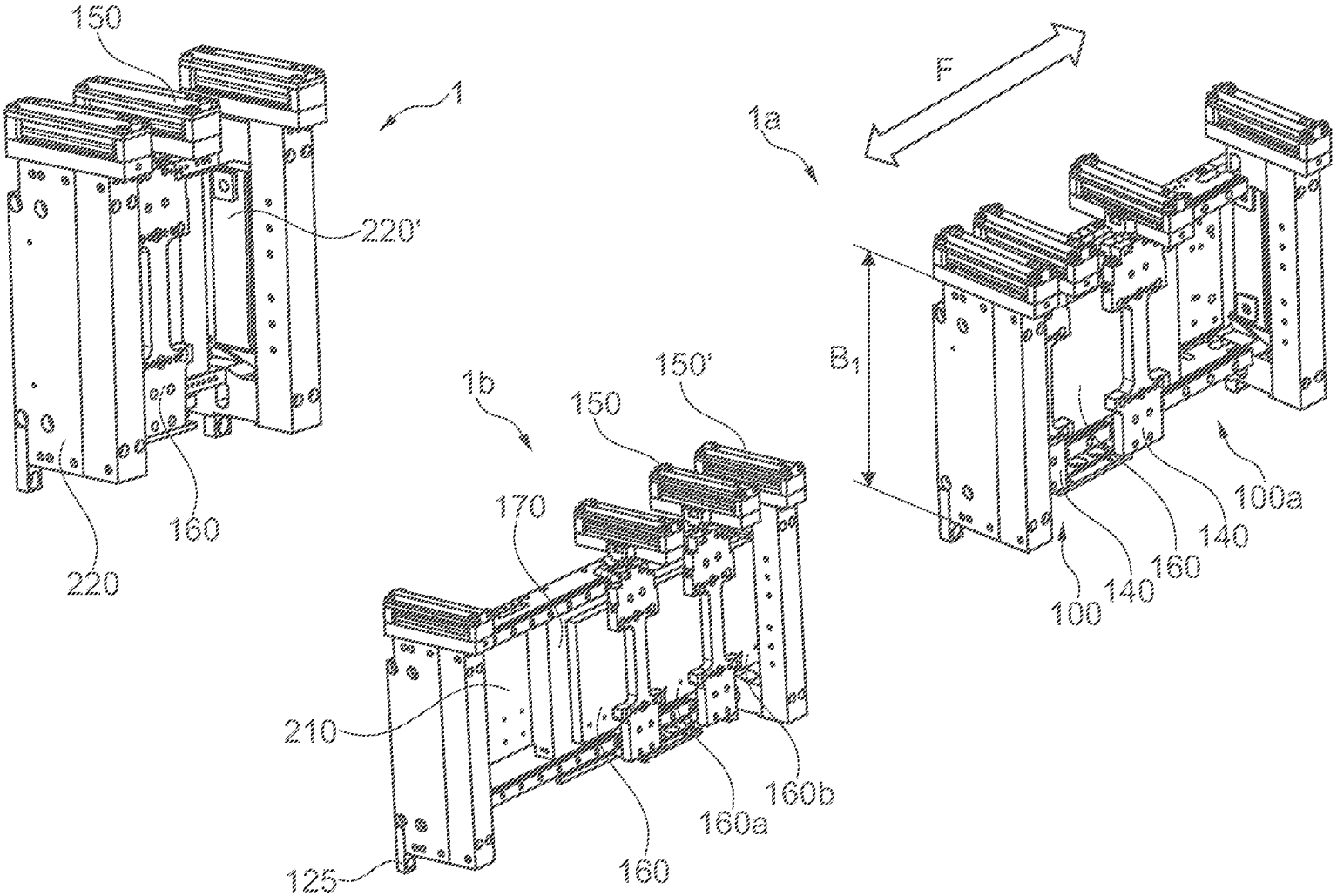
FIG. 13 shows three feeders of different length according to three embodiments of the present invention, wherein the embodiments are similar to FIG. 9 but have a different height.

FIG. 13 shows three feeders 1, 1*a*, 1*b* of different length according to three rotated embodiments of the present invention, wherein the embodiments are similar to FIG. 9 (correspondingly the description therein likewise applies to FIG. 13) but have a different height. The width B1 of the end plate 120 of the embodiments according to FIG. 12 corresponds to a height in the rotated embodiment according to FIG. 13, as indicated in FIG. 13.

The feeder 1 has a length of Lo (one pair of side support modules 100). The feeder is has a length of 2×Lo (two pairs of side support modules 100, 100*a*). The feeder 1*b* has a length of 3×Lo (three pairs of side support modules 100, 100*a*, 100*b*). Due to the modularity, substantially the same components as in FIG. 12 can be used.

In the three feeders 1, 1*a*, 1*b* according to FIG. 13, the passage width of the holding devices 150, 150' is approximately 60 mm to 120 mm, preferably 65 mm to 95 mm, further preferably 70 mm to 90 mm, most preferably 75 mm to 85 mm or even 80 mm.

Figure 14:
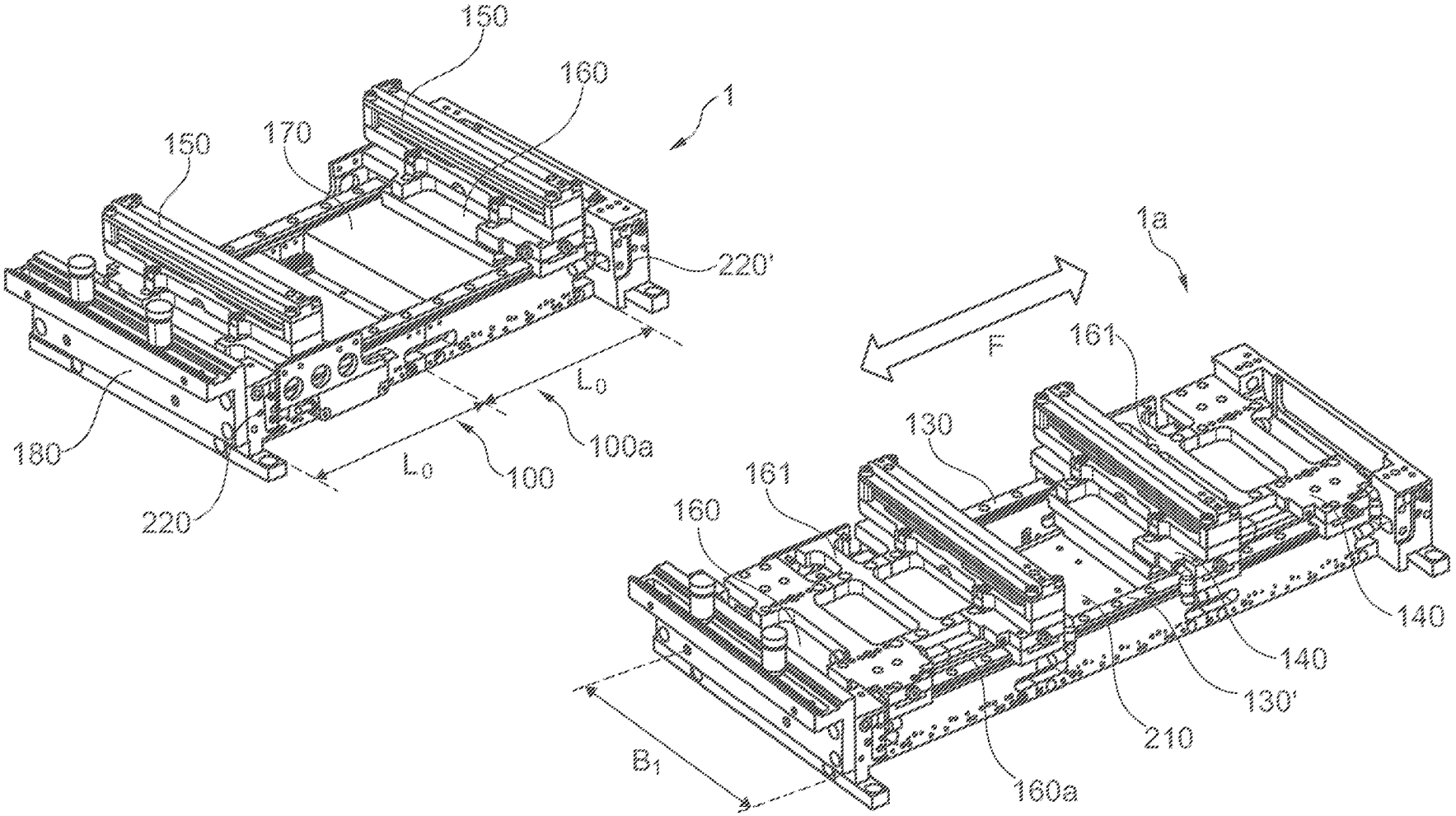
FIG. 14 shows two feeders of different length according to two embodiments of the present invention, wherein the embodiments are similar to FIG. 10 but have a different width.

FIG. 14 shows two feeders 1, 1*a* of different length according to two embodiments of the present invention, wherein the embodiments are similar to FIG. 10 (correspondingly the description therein likewise applies to FIG. 14) but have a different width. The width B1 of the end plate 120 of the embodiments according to FIG. 14 corresponds to that of FIG. 12 (correspondingly the description therein likewise applies to FIG. 14).

The feeder 1 has a length of 2×Lo (two pairs of side support modules 100, 100*a*). The feeder is has a length of 3×Lo (three pairs of side support modules 100, 100*a*, 100*b*, not indicated separately for reasons of clarity).

The feeder 1 in FIG. 14 comprises a respective magnetic plate 160 on both sides.

The feeder is in FIG. 14 comprises two respective magnetic plates 160, 160*a* (likewise similar) on both sides and has a connecting element 161 between the similar carriage plates 140. The connecting element 161 can serve as a spacer between the carriage plates 140. In addition, the connecting element 161 can detachably mount the two magnetic rails 160 and 160*a* to one another. In this way, the same magnetic plates 160, 160*a* can be used and a longer magnetic plate does not have to be used. In particular, the magnetic plates of the feeders 1, 1*a* correspond to those magnetic plates of the feeders 1, 1*b* from FIG. 13 and of the feeders 1, 1*b* from FIG. 12.

Figure 15:
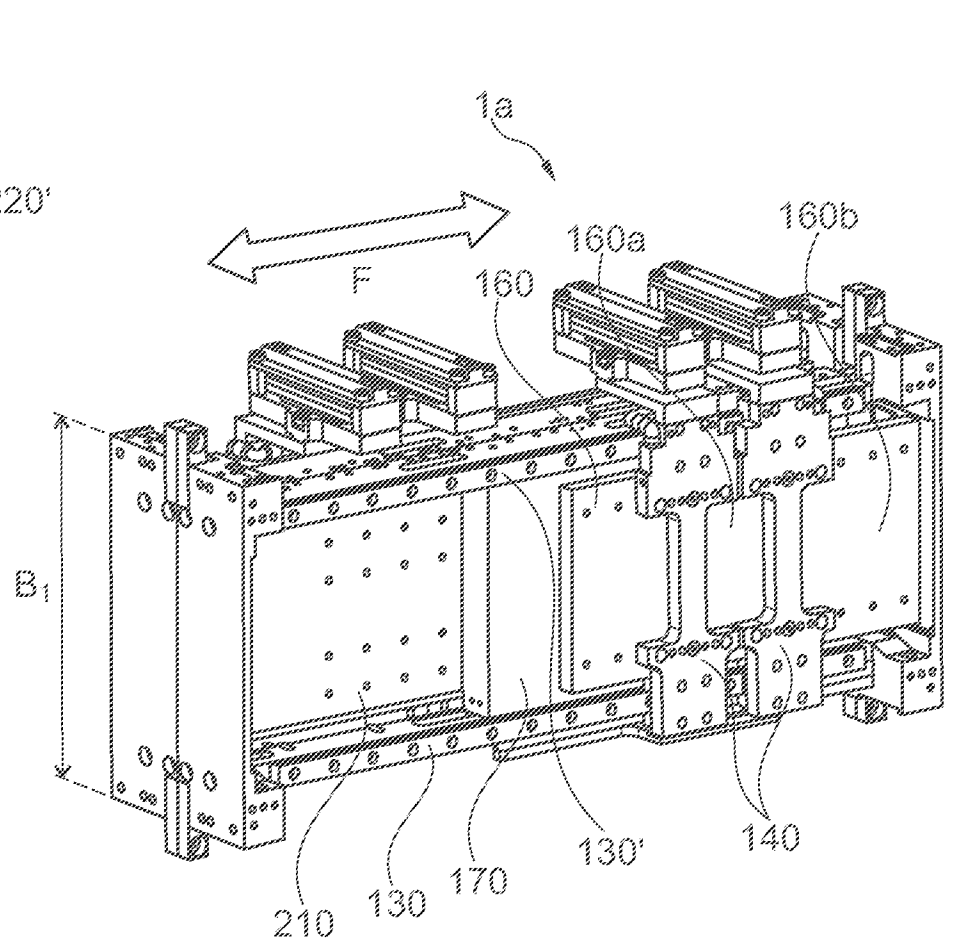
FIG. 15 shows two feeders of different length according to two embodiments of the present invention, wherein the embodiments are similar to FIG. 11 but have a different width.
Figure 15:
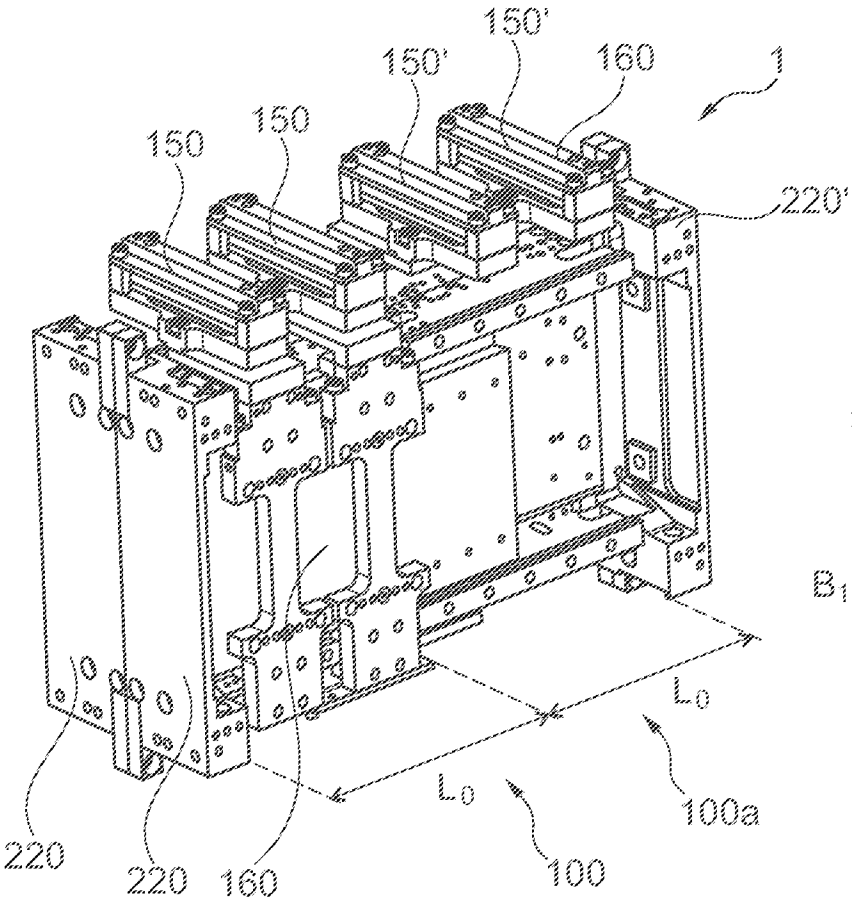

FIG. 15 shows two feeders 1, 1*a* of different length according to two embodiments of the present invention, wherein the embodiments are similar to FIG. 11 (correspondingly the description therein likewise applies to FIG. 15) but have a different width. The width B1 of the end plate 120 of the embodiments according to FIG. 15 corresponds to that of FIG. 12 (correspondingly the description therein likewise applies to FIG. 15). As described herein, two feeders arranged on one another on the rear side and detachably mounted to each other respectively form the feeder 1 and the feeder 1*a*.

The feeder 1 has a length of 2×Lo (two pairs of side support modules 100, 100*a*). The feeder is has a length of 3×Lo (three pairs of side support modules 100, 100*a*, 100*b*, not indicated separately for reasons of clarity).

The spacing of the carriage plates 140 in the conveying direction F can be made variable due to the universal mounting means of the carriage plates 140 and the magnetic rails 160, 160*a*, 160*b* (all similarly). Consequently, the feeder 1, 1*a* can be adapted to diverse feeder applications. The holding devices 150, 150' are detachably mounted via gripper plates with the carriage plates 140 at the same axial height (along the conveying direction F) as the carriage plates 140. Consequently, a changed spacing of the carriage plates 140 causes a changed spacing of the holding devices 150, 150'. The distance between two holding devices 150, 150' movable in the same directions can thus be set variably, depending on the desired/allowed/permitted sag of strip material.

In contrast to the embodiment from FIG. 14, an adjacent arrangement of the carriage plates 140 is shown by way of example in FIG. 15. No connecting element 161 (shown in FIG. 14) is thus necessary, since the carriage plates 140 extend at least partially over all three magnetic plates 160, 160*a*, 160*b* in the conveying direction (over less than approximately half of the magnetic plate 160, over the entire magnetic plate 160*a* and over less than approximately half of the magnetic plate 160*b*). A detachable mounting of all three magnetic plates 160, 160*a*, 160*b* by means of the two carriage plates 140 is consequently made possible.

As also shown in FIGS. 12 and 13, the magnetic rail 160 of the feeder 1 is more than twice as long as the magnetic rail 160 (the length of which corresponds to that of the magnetic rail 160*a* and 160*b* due to the similarity) of the feeder 1*a*. In this way, an enlarged overlap between the drive unit 170 and the magnetic rail 160 during the operation of the feeder 1 can be achieved in the feeder 1. However, the modularity according to the invention makes it possible that, if desired, two similar magnetic rails 160, 160*a* are also used in the feeder 1.

It goes without saying that the similar magnetic plates 160, 160*a*, 160*a* of the feeder is correspond to those magnetic plates of the feeders 1, 1*b* from FIG. 14, of the feeders 1, 1*b* from FIG. 13 and of the feeders 1, 1*b* from FIG. 12. The carriage plates 140 are of the same width in all feeders.

Overview of Some Embodiments

Some of the components used in the embodiments described above are indicated as examples in Table 1 below. Here, the embodiment "L" represents lying embodiments (cf. in FIGS. 8 and 12).

"R" represents embodiments in which a longitudinal axis of the holding device extends substantially parallel to the normal of the carriage plate (cf. in FIGS. 9 and 13).

"T" represents embodiments in which the conveying modules are movably arranged on the support structure independently of one another in the conveying direction (cf. in FIGS. 10 and 14).

"X" represents embodiments in which the conveying modules are configured such that they can at least partially overlap in the conveying direction (cf. in FIGS. 11 and 15).

"A" indicates, for example, a side support module of type A (all side support modules of type A are thus identical). "B" indicates a different nature to "A", for example, the base support module B is twice as long as the base support module A. The indication "A*" means, for example, that the base support module A* differs from the base support module A only in the nature of the width. The indication "A" means, for example, that the gripper A differs from the gripper A and from the gripper A* only in the nature of the width. The indication "160/240" means, for example, that the gripper passage width can be a value of 160 mm or 240 mm.

TABLE 1

Examples of feeders according to some embodiments

| Embodiment | Width | Length [×L0] | Gripper passage width [mm] | Pair of side support modules (100) | Base support module (110) | Carriage plate (140) | Gripper (150) | Magnetic rail (160) |
|---|---|---|---|---|---|---|---|---|
| L | B0 | 1 | 80 | A | A | A | A | A (1x) |
| L | B0 | 2 | 80 | A | B | B | A | A (2x) |
| L | B0 | 3 | 80 | A | C | B | A | A (3x) |
| R | B0 | 1 | 40 | A | A | A | A* | A (1x) |
| R | B0 | 2 | 40 | A | B | B | A* | A (2x) |
| R | B0 | 3 | 40 | A | C | B | A* | A (3x) |
| T | B0 | 2 | 80 | A | B | A (2x) | A | A (2x) |
| T | B0 | 3 | 80 | A | C | B (2x) | A | A (4x) |
| X | B0 | 1 | 80 | A | A (2x) | A (2x) | A* | A (2x) |
| X | B0 | 2 | 80 | A | B (2x) | B (2x) | A* | A (4x) |
| L | B1 | 1 | 160/240 | A | A* | C | A** | A* (1x) |
| L | B1 | 2 | 160/240 | A | B* | C (2x) | A** | B (1x) |
| L | B1 | 3 | 160/240 | A | C* | C (2x) | A** | A* (3x) |
| R | B1 | 1 | 80 | A | A* | C | A | A* (1x) |
| R | B1 | 2 | 80 | A | B* | C (2x) | A | B (1x) |
| R | B1 | 3 | 80 | A | C* | C (2x) | A | A* (3x) |
| T | B1 | 2 | 160 | A | B* | C (2x) | A** | A* (2x) |
| T | B1 | 3 | 160 | A | C* | C (4x) | A** | A* (4x) |
| X | B1 | 2 | 80 | A | A* (2x) | C (4x) | A | B (2x) |
| X | B1 | 3 | 80 | A | B* (2x) | C (4x) | A | A* (6x) |

Even if not indicated separately, it is understood that in all the exemplary embodiments described herein the side support modules 105, 105' (a pair of these is referred to as 100 herein for instance) can be formed similarly.

In addition, in the above-described exemplary embodiments the feeders can also be referred to as gripper feeders. Furthermore, in the above-described exemplary embodiments, strip materials with a thickness of at least 0.05 mm and/or at most 20 mm can be conveyed. Preferably, strip materials with a thickness of 0.05 to 15 mm, further preferably of 0.05 mm to 10 mm, further preferably of 0.05 mm to 8 mm, most preferably of 0.1 mm to 5 mm can be conveyed. Adaptations to the holding devices can be provided in order to convey thicker/thinner strip materials.

In the above-described exemplary embodiments, the components preferably comprise metals as component materials. The materials of the base support module(s), side support module(s) and/or end plates are preferably aluminum, which in some cases can also be anodized. The holding devices likewise comprise aluminum, this ensures a low mass and promotes higher cycle rates. The holding devices likewise comprise steel for clamping plates of the holding devices, wherein the clamping plates come into contact with the strip material.

The scope of protection is determined by the claims and is not limited by the exemplary embodiments and/or figures.

What is claimed is:

1. A feeder for conveying a workpiece, in particular strip material, in a conveying direction, comprising:

at least one first pair of side support modules;

a base support module arranged between the side support modules; and at least one conveying module;

wherein the side support modules are detachably connected to the base support module transversely to the conveying direction to form a U-shaped support structure of the feeder along the conveying direction;

wherein the conveying module is movably arranged on the support structure in the conveying direction, wherein the side support modules are elongated and substantially define a U-shaped profile with legs of different lengths, wherein the smaller leg of each side support module is substantially flush with the base support module.

2. The feeder according to claim 1, further comprising a guide rail arranged on the support structure, and wherein the side support modules have third mounting means for detachably connecting the guide rail to a side support module.

3. The feeder according to claim 2, wherein the guide rail and the third mounting means of the side support modules are configured such that the guide rail can be detachably connected to a plurality of side support modules arranged in the conveying direction at the same time.

4. A feeder for conveying a workpiece, in particular strip material, in a conveying direction, comprising:

at least one first pair of side support modules;

a base support module arranged between the side support modules; and at least one conveying module;

wherein the side support modules are detachably connected to the base support module transversely to the conveying direction to form a U-shaped support structure of the feeder along the conveying direction;

wherein the conveying module is movably arranged on the support structure in the conveying direction, wherein the base support module has second mounting means arranged in pairs along the conveying direction, wherein the feeder comprises at least one drive unit received in the support structure and configured to move the conveying module, wherein the second mounting means of the base support module are arranged such that the drive unit can be detachably connected to the base support module at variable positions along the conveying direction.

* * * * *